US007790977B2

(12) United States Patent
Sato

(10) Patent No.: US 7,790,977 B2
(45) Date of Patent: Sep. 7, 2010

(54) COMPONENT TONE SYNTHETIC APPARATUS AND METHOD A COMPUTER PROGRAM FOR SYNTHESIZING COMPONENT TONE

(75) Inventor: Yasushi Sato, Hamamatsu (JP)

(73) Assignee: Kawai Musical Instruments Mfg. Co., Ltd., Hamamatsu-shi (JP)

( * ) Notice: Subject to any disclaimer, the term of this patent is extended or adjusted under 35 U.S.C. 154(b) by 0 days.

(21) Appl. No.: 12/222,222

(22) Filed: Aug. 5, 2008

(65) Prior Publication Data

US 2009/0049978 A1 Feb. 26, 2009

(30) Foreign Application Priority Data

Aug. 22, 2007 (JP) ..... 2007-216302

(51) Int. Cl.
*G10H 7/00* (2006.01)

(52) U.S. Cl. ..... 84/625; 84/663; 84/608

(58) Field of Classification Search ..... 84/608, 84/625, 627, 660, 663
See application file for complete search history.

(56) References Cited

U.S. PATENT DOCUMENTS

RE30,906 E * 4/1982 Hiyoshi et al. ..... 84/627
5,094,136 A * 3/1992 Kudo et al. ..... 84/603
5,149,903 A * 9/1992 Iizuka et al. ..... 84/627
5,359,146 A * 10/1994 Funaki et al. ..... 84/624
5,412,155 A * 5/1995 Kosugi ..... 84/627
5,514,831 A * 5/1996 Imamura ..... 84/627
5,786,541 A * 7/1998 Komano et al. ..... 84/663
5,998,725 A * 12/1999 Ohta ..... 84/627
6,143,974 A * 11/2000 Dahl ..... 84/659
6,201,175 B1 * 3/2001 Kikumoto et al. ..... 84/605
6,255,576 B1 * 7/2001 Suzuki et al. ..... 84/604
6,881,888 B2 * 4/2005 Akazawa et al. ..... 84/604
6,911,591 B2 * 6/2005 Akazawa et al. ..... 84/616
7,253,352 B2 * 8/2007 Hsieh et al. ..... 84/627
7,259,315 B2 * 8/2007 Tamura et al. ..... 84/627
7,396,992 B2 * 7/2008 Tamura et al. ..... 84/625
7,557,288 B2 * 7/2009 Akazawa et al. ..... 84/604

(Continued)

FOREIGN PATENT DOCUMENTS

JP A-08-106291 4/1996

(Continued)

*Primary Examiner*—David S. Warren
(74) *Attorney, Agent, or Firm*—Oliff & Berridge, PLC

(57) ABSTRACT

The component tone signal commonly shared by a plurality of keys does not turn to a release signal if one of the keys is released to stop a tone and also while tones of other keys are sustained; the on-data of each key of the keyboard is multiplied in multiplier by the amplitude data set by the draw-bar circuit with the multipliers, added with adder and sent to the sound source circuit; the sine waves of the same waveform and different cycles are generated according to the amplitude data, are synthesized with envelopes from envelope generator, and the added with adder; this envelope generator is disposed at every sound source circuit, that is, every one of the common component tone signals; the component tone signal/sine wave commonly shared by a plurality of keys does not turn to direct to a release state if one of the keys is operated to stop a tone, and also directs not to turn to a release state but to maintain a sustain state while tones of the other keys are sustained.

19 Claims, 22 Drawing Sheets

U.S. PATENT DOCUMENTS

| | | | | |
|---|---|---|---|---|
| 2004/0226434 | A1* | 11/2004 | Hsieh et al. | 84/627 |
| 2005/0120870 | A1* | 6/2005 | Ludwig | 84/661 |
| 2007/0107586 | A1* | 5/2007 | Yip | 84/627 |

FOREIGN PATENT DOCUMENTS

| | | |
|---|---|---|
| JP | A-08-137469 | 5/1996 |
| JP | A-08-137470 | 5/1996 |
| JP | A-08-137471 | 5/1996 |
| JP | A-08-146965 | 6/1996 |
| JP | A-11-194769 | 7/1999 |

* cited by examiner

FIG. 10

4

| absolute time | envelope speed | component tone flag |
|---|---|---|
| Ta1−Tb0 | ESa1 | a |
| Ta2−Tb0 | ESa2 | a |
| Tb1−Tb0 | ESb1 | b |
| Ta3−Tb0 | ESa3 | a |
| Tb2−Tb0 | ESb2 | b |
| Ta4−Tb0 | ESa4 | a |
| Tb3−Tb0 | ESb3 | b |
| Tb4−Tb0 | ESb4 | b |

↓

41

| synthetic envelope time Ets | synthetic envelope speed Ess |
|---|---|
| Ta1−Tb0 | ESa1+ESb1 |
| (Ta2-Tb0)-(Ta1-Tb0)=Ta2-Ta1 | ESa2+ESb1 |
| (Tb1-Tb0)-(Ta2-Tb0)=Tb1-Ta2 | ESb1+ESa3 |
| (Ta3-Tb0)-(Tb1-Tb0)=Ta3-Tb1 | ESa3+ESb2 |
| (Tb2-Tb0)-(Ta3-Tb0)=Tb2-Ta3 | ESb2+ESa4 |
| (Ta4-Tb0)-(Tb2-Tb0)=Ta4-Tb2 | ESa4+ESb3 |
| (Tb3-Tb0)-(Ta4-Tb0)=Tb3-Ta4 | ESb3+ − |
| (Tb4-Tb0)-(Tb3-Tb0)=Tb4-Tb3 | ESb4+ − |

COMPONENT TONE SYNTHETIC APPARATUS AND METHOD A COMPUTER PROGRAM FOR SYNTHESIZING COMPONENT TONE

BACKGROUND OF THE INVENTION

1. Field of the Invention

The present invention relates to an apparatus and a method for synthesizing component tones, and in particular to an apparatus and a method for synthesizing a plurality of component tones into one tone.

2. Description of the Prior Art

Traditionally such apparatuses described as follows have been contrived. An apparatus generates and synthesizes a plurality of component tones or sine waves of different frequencies. Combination of the synthesized component tones or sine waves is reorganized in order to change timbres.

However, different synthesized tones may share the same sine waves or component tones in common. Therefore it has been unnecessary to generate common sine waves or component tones for generating every synthesized tone. Also envelopes formed from different tones sometimes share common sine waves or component tones and it has been unnecessary that an envelope is formed separately from each generation of the common sine wave or component tone. The present invention comprises a factor to improve the invention of Patent No. 3673384.

3. Related Works

Japanese Patent No. 3673384

SUMMARY OF THE INVENTION

In order to achieve the purpose discussed above, the present invention aims to provide a plurality of means for directing generation and extinction of said tones of different pitches and sharing a part or all of the above numerous component tone signals; and when some of the means of the plurality of the above direction means have been generating tones extinct the tone, envelopes of the component tone signals to extinct tones are distinguished from envelopes of the other component tone signals not to extinct tones in order to get into the release state only the envelopes of the component tone signals to extinct tones and to maintain the state of the envelopes of the other component tone signals not to extinct tones or of synthesized envelopes instead of getting into the release state.

As a result if there is one operation to direct to stop a tone, all the component tone signals commonly controlled by a plurality of the direction means do not direct the release, the component tones which are not connected with the stop directions are not released, and one operation to stop a tone does not change components of tones controlled by other directions.

As all the component tone signals commonly controlled by a plurality of the direction means do not direct the release if there is one operation to direct to stop a tone, it is possible to sustain tones controlled by the other directions than stopping the tone. This function is adoptable especially to draw-bar organs (keyboard instruments). In traditional draw-bar organs, VCA (voltage controlled amplifier) controls the release of component tone signals shared by a plurality of tones. Therefore by one operation to stop a tone, all the component tone signals commonly controlled by a plurality of direction means gives a release state.

In addition, the present invention provides the following state: While envelopes of some component tone signals commonly controlled as described above are in the sustain state and when some of the directions which have been generating tones simultaneously turn to direct to stop some of the tones, envelopes of component tone signals which are not connected with the stop direction or synthesized envelopes are kept in the sustain state, and also envelopes of the component tone signals connected with the stop direction are in the sustain or release state.

Accordingly if there is one operation to stop a tone while the other direction means are holding tones in the sustain state, the sustain state is not switched to the release state but is able to be maintained in spite of the stopping operation. This function is especially adoptable to draw-bar organs (key board instruments). In traditional draw-bar organs, VCA controls the release of component tone signals shared by a plurality of tones. Therefore by one operation to stop a tone, all the component tone signals commonly controlled by a plurality of direction means gives a release state and the sustain state cannot be maintained.

The present invention also provides the following state when at least two synthesized tones are sounding simultaneously but the start and the stop of the tones are not simultaneous: at the start of the subsequent synthesized tone or at the stop of the earlier synthesized tone, the envelopes of the component tone signals commonly shared by the synthesized tones are synthesized into one envelope of one component tone.

As a result it is unnecessary to form an envelope separately from every component tone signal incorporated in every synthesized tone since the envelopes commonly shared by the component tone signals are synthesized.

The present invention also provides the following state: Numerous component tones signals are regularly emitted. Their waveforms are the same but the frequency value is twice or more different from each other and the each frequency is fixed. All the component tone signals are synthesized to generate one tone.

Thus as numerous component tones signals are regularly emitted, such processes become unnecessary as to start emitting component tone signals from the totally un-emission state, and to end emitting the component tone signals from the emission state. It quickens processing of starting and stopping tones and the actual start and stop of the tones.

The component tone signals include fundamental frequencies (pitch), frequency components that are integral multiple/harmonics of the fundamental frequencies, frequency components that are non-integral multiple/non-harmonics of the fundamental frequencies, higher or lower tones than the fundamental frequencies. Amplitudes of the component tones with non-fundamental frequencies are smaller or larger than amplitudes of the component tones with the fundamental frequencies.

BRIEF DESCRIPTION OF THE DRAWINGS

FIG. 10 shows an example of data of an envelope synthesized from component tones a and b of the same frequency.

DESCRIPTION OF THE PREFERRED EMBODIMENT

(1) Summary of the Preferred Embodiment

Figure 1:
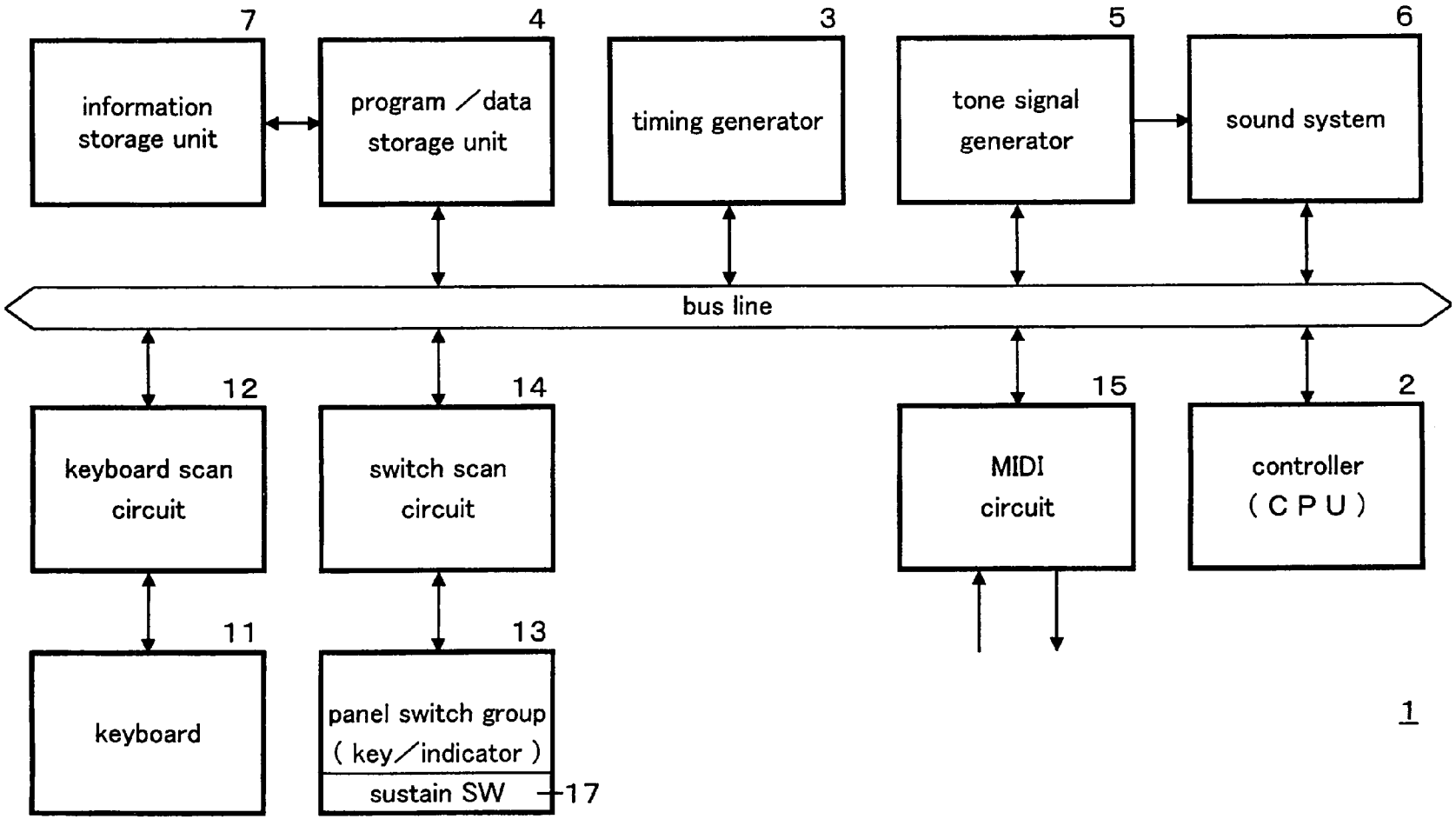
FIG. 1 shows a whole circuit of the component tone synthesis apparatus.

The component tone signal commonly shared by a plurality of keys does not turn to a release signal if one of the keys is released to stop a tone and also while tones of other keys are sustained.

The on-data of each key of the keyboard 11 is multiplied in multipliers 61 and 62 by the amplitude data set by the draw-bar circuit 65 with the multipliers 61 and 62, added with adder 66 and sent to the sound source circuit 63 . . . . The sine waves of the same waveform and different cycles are generated according to the amplitude data, are synthesized with envelopes from envelope generator 67, and the added with adder 64.

This envelope generator 67 is disposed at every sound source circuit 63, that is, every one of the common component tone signals. The component tone signal/sine wave commonly shared by a plurality of keys does not turn to direct to a release state if one of the keys is operated to stop a tone, and also directs not to turn to a release state but to maintain a sustain state while tones of the other keys are sustained.

When common component tone signals are incorporated in some envelopes and the envelopes are synthesized into one envelope, processing of starting and stopping tones is made quicker and the actual start and stop of the tones are made quicker as numerous component tone signals are regularly emitted.

The absolute times of each phase of the synthesized envelopes are arranged form the longest to the shortest (step 56). The absolute times are referred to as (Ta2–Tb0), (Ta3–Tb0), (Ta4–Tb0), (Tb1–Tb0), (Tb2–Tb0), (Tb3–Tb0), (Tb4–Tb0). Each envelope time data ETs of the synthesized envelope signal comes out (step 57, shown in the left flame of FIG. 10 (2)). Then each envelope speed data ESs of the synthesized envelope signal comes out (step 58, shown in the right flame of FIG. 10 (2)). Envelope data of the sustain state is similarly obtained after the key-off to stop tones (step 33).

(2) The Whole Circuit

FIG. 1 shows whole circuit 1 of automatic play device or electronic musical instruments including a whole circuit executing a computer program to practice the component tone synthesis method, a whole circuit practicing the component tone synthesis method, a component tone synthesis apparatus, a tone envelope control apparatus, and a tone control apparatus.

Each key of keyboard 11 directs generation and attenuation of tones, keyboard scan circuit 12 practices scanning, and a key on/off data is detected and is written in program/data storage unit 4 by controller (CPU) 2. Then it is compared with the data showing the on or off status of each key which has been stored in program/data storage unit 4, and controller 2 determines the on or off event of each key.

Each key of keyboard 11 has a steps touch switch serving as a speed sensor, an acceleration sensor, and a pressure sensor. Each steps switch conducts the above mentioned scan, and the on-event/off-event is detected at the first on/off of one of the steps of the switch. The sensor of the steps switch detects and generates the touch information, that is, the initial touch data and the after touch data showing the speed and strength of the touch.

Keyboard 11 includes a lower keyboard, an upper keyboard and a pedal keyboard. Each of them generates different timbres, that is, tones of different envelope signals (waveforms). The upper keyboard is able to sound two timbres simultaneously at one key-on. Keyboard 11 may be replaced by an electronic stringed instrument, an electronic wind instrument, an electronic percussion instrument (pad, etc.) or a computer keyboard.

Each switch in panel switch group 13 is scanned by switch scan circuit 14. This scanning detects the data showing the on or off status of each switch, and controller 2 writes the data in program/data storage unit 4. It is compared with the data showing the on or off status of each switch which has been stored in program/data storage unit 4, and controller 2 finds out either of the on or off event of each switch.

MIDI circuit 15 is an interface to exchange performance information with an externally connected electronic musical instrument. The performance information is under MIDI (musical instrument digital interface) standard, and tones are generated based on the performance information.

Keyboard 11 or MIDI circuit 15 includes automatic play device. The performance information (tone generation information) given from keyboard 11, panel switch group 13, MIDI circuit 15 and automatic play device is information to generate tones.

The performance information (tone generation information) is musical factor information such as pitch (register), i.e. factor to determine register, sounding time, performance field, the number of tones, resonance. The sounding time shows the time passed from the start of a sounding tone. The performance field information shows performance parts, tone parts, musical instrument parts and it is responsive to melody, accompaniment, code, bass, rhythm, MIDI, upper keyboard, lower keyboard, foot keyboard, solo keyboard, etc.

The above-mentioned pitch information is received as a key number data KN. The key number data KN includes octave data (register data) and tone name data. The performance information is received as a part number data PN. The part number data PN serves to distinguish performance areas and is set up according to which of the performance areas the tones are generated from.

The sounding time information is received as a tone time data TM. The data may be based on the time count data from the key-on event or the envelope phase may be utilized. The sounding time information is detailed in the specification and the figures of Japanese Patent Application No. 6-219324 as information of time passed from the start of a sounding tone.

The information of the number of tones shows the number of tones simultaneously sounding. For instance, it is based on the number of tones whose on/off data of assignment memory 40 is "1". The number of the sounding tones is found based on the flowcharts shown in the FIGS. 9 and 15 of Japanese Patent Application No. 6-242878, FIGS. 8 and 18 of Japanese Patent Application No. 6-276855, FIGS. 9 and 20 of Japanese Patent Application No. 6-276857 and FIGS. 9 and 21 of Japanese Patent Application No. 6-276858.

Panel switch group 13 includes various switches such as timber tablets, effect switches, rhythm switches, pedals, wheels, levers, dials, handles, touch switches for musical instruments. The pedals are damper pedals, sustain pedals, mute pedals, and soft pedals, etc.

These switches work to give tone control information, which controls tones that have been generated, including musical factor information, timbre information (factors to determine timbres), touch information (speed/power of sounding operation), information on the number of tones, resonance information, effect information, rhythm information, sound image(stereo) information, quantize information, modulation information, tempo information, volume information and envelope information. The musical factor information is incorporated into the performance information (tone information). It is inputted by the above mentioned switches. It is incorporated into the automatic play information and the performance information exchanged by the interface.

Panel switch group 13 includes sustain switch 17. When sustain switch 17 is turned on or off, the release time of the envelope of the tone becomes longer, which makes the tone to sound more lingering. If sustain switch 17 is turned on or off again, the release time of the envelope of the tone becomes shorter, which makes the tone to sound normally. These two states of tones are switched every time sustain switch 17 is turned on or off.

Therefore sustain switch 17 works to switch the sustain state in which the envelope is attenuated gradually and slowly after the end of the sounding operation and the release state in which the envelope is attenuated in a normal speed. In the release state the envelope of each component tone signal approaches to "0". In the sustain state the envelope of each component tone signal approaches to "0" gradually and slowly.

The above mentioned timbre information corresponds to the kind of the musical instruments (sounding media/sounding means) such as keyboard instruments (piano, etc.), wind instruments (flute, etc.), stringed instruments (violin, etc.), percussion instruments (drum, etc.) and are received as a tone number data TN. The above mentioned envelope information includes the envelope level EL, the envelope time ET and the envelope phase EF, etc.

Such musical factor information is sent to controller (CPU) 2 where a variety of signals that will be described later, data and parameters are switched to determine the contents of musical tones. The performance information (tone generation information) and tone control information are processed by controller 2, various data are sent to tone signal generator 5, and the tone waveform signal MW is generated. Controller 2 consists of CPU, DSP (digital signal processor), ROM and RAM. A controller such as controller 2 may be disposed at every circuit shown in FIG. 1.

Program/data storage unit 4 (internal storage medium/means) includes a storage unit such a ROM, a writeable RAM, a flush memory or an EEPROM. A program of a computer stored in information storage unit 7 (external storage medium/means) such as an optical disk or a magnetic disk, is transcribed and stored (installed/transferred) into the program/data storage unit 4. The storage medium of this program includes a communication medium.

The installation (transfer/copy) process is practiced automatically when information storage unit 7 is set at the main tone generation apparatus or when the main tone generation apparatus is turned on, or it is installed by an operator manually. This program complies with flowcharts that will be described later, with which controller 2 practices various processes.

The main tone generation apparatus may store other operation systems, system programs (OS), and some other programs in advance. The program formerly mentioned may be executed along with the OS and other programs as long as the program is able to practice the processes and perform the functions recited in the claims by itself or with other programs when the program is installed to the main apparatus (the computer).

Otherwise, the program may be partly or wholly stored and practiced at another or some other apparatus outside of the main apparatus. Data and program to be processed/data and program already processed may be exchanged between the main apparatus and the other apparatus by communication medium so that the present invention can be performed by the main apparatus and the other apparatus as a whole.

Program/data storage unit 4 stores the musical factor data and the various data previously mentioned, and other variety of data. The variety of data includes data necessary for the time-division processing and data to be assigned to the time-division channels.

Tone signal generator 5 always feed numerous component tone signals having different frequencies, for instance, two times or more difference in frequencies, that is, difference of eight octaves with each other and having the same waveform such as a sine wave for instance. The component tone signals of the numerous sine waves have unchanged, fixed frequencies. The component tone signals of the numerous sine waves are synthesized at a certain ratio, that is, the ratio according to the envelope levels, and sound system 6 outputs and generate one tone.

The numerous component tone signals having their sine wave are synthesized into one synthesized tone. A plurality of tones are synthesized in such away and generated. The synthesis ratio or the combination of the component tone signals of the sine waves is switched and changed according to the information formerly mentioned such as timbre, touch, pitch, register, sounding time, performance field, the number of tones and resonance.

Timing generator 3 outputs timing control signals to the circuits to maintain synchronism of all circuits of the tone generating apparatus. The timing control signals include clock signals of each of the periods, signals of a logical product or a logical sum of these clock signals, channel clock signals having periods of channel-dividing time in the time-division processing, clock signals with integral multiplied or integral divided frequencies by these signals, channel number data CHNo and time count data TI.

The time count data TI shows an absolute time, that is, the passage of time. The cycle between the overflow resets of the time count data TI is longer than the longest sounding time of each tone and is sometimes set up several times longer.

(3) Tone Signal Emission Unit 5

Figure 2:
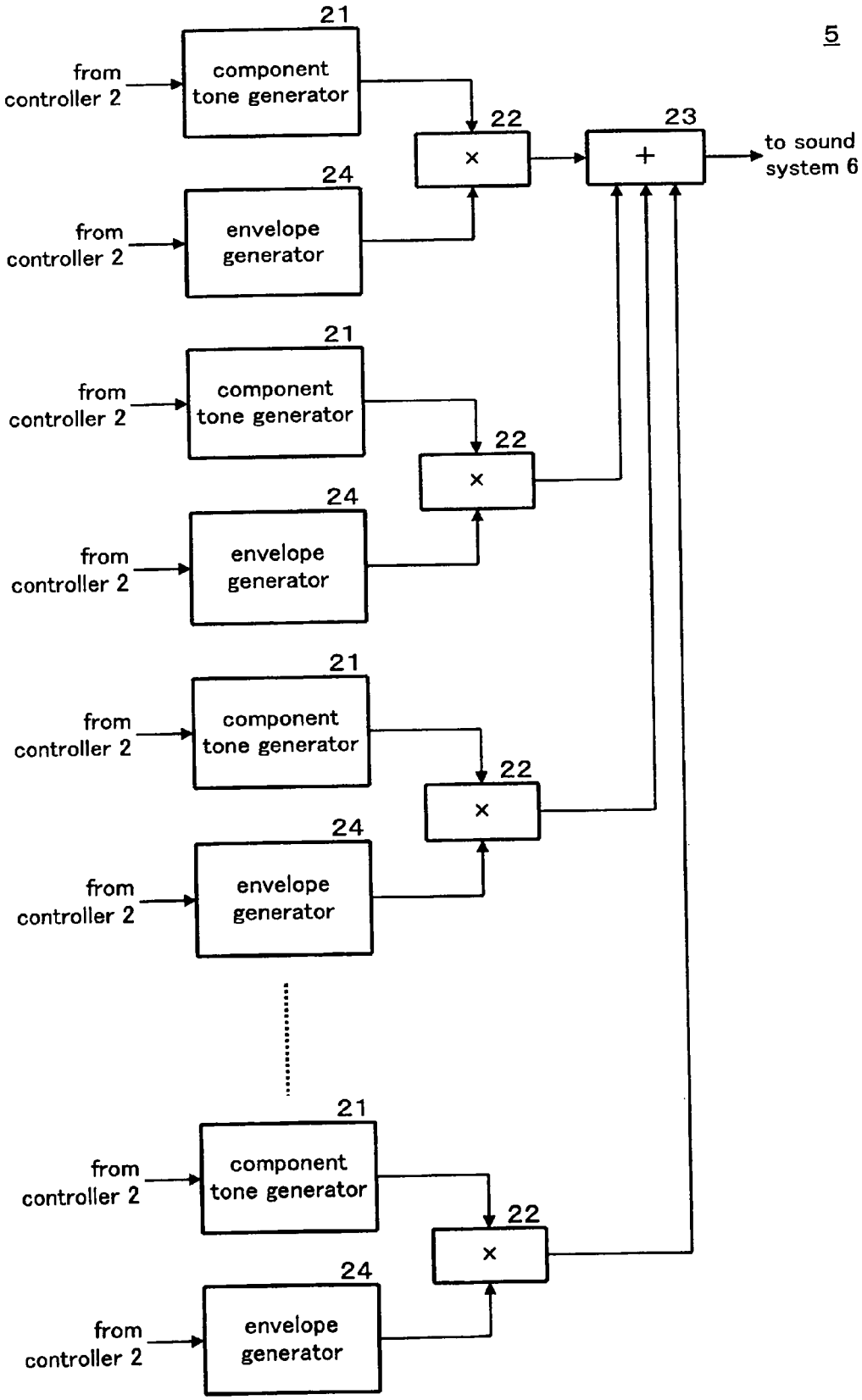
FIG. 2 shows tone signal emission unit 5.

FIG. 2 shows tone signal emission unit 5. The unit has many, e.g. one hundred and eight component tone generators 21 . . . . Twelve generators are disposed for one octave and there are eight octaves, i.e. ninety-six generators in all: 12×8=96. Twelve generators are added to the highest tone of each octave. So there are one hundred and eight generators: 96+12=108.

There are thirteen component tone generators 21 . . . in one octave:12+1=13 The thirteen generators send component tone signals, and the difference between the highest and lowest frequencies of the signals is one octave, i.g. two times. There is difference of 12-powers root of 2 between each of the frequencies. The difference of frequencies mentioned above is one example and other differences are acceptable.

The one hundred and eight component tone generators 21 . . . send component tone signals of sine waves of the same waveform and different frequencies regularly while the electric power is on. The frequencies of the component tone signals of the numerous sine waves are fixed and invariable.

Each of one hundred and eight multiplier 22 . . . multiplies and synthesizes an envelope signal/waveform of a component tone signal of a sine wave sent from each of component tone generators 21 . . . . A level/ratio of each component tone signal is varied and controlled from "0" to a certain proportion. The component tone signals synthesized with the envelope signals are synthesized into one tone signal by adder 23.

Each of the envelope signals is sent from each of one hundred and eight envelope generators 24 . . . . The envelope signal changes a level/ratio of each of the above tone signals from "0" to a certain proportion. If the above component tone signals are not necessary to the above synthesized tones, the level/ratio of the envelope of the component tone signal is set as "0".

(4) Envelope Generators 24 . . .

Figure 3:
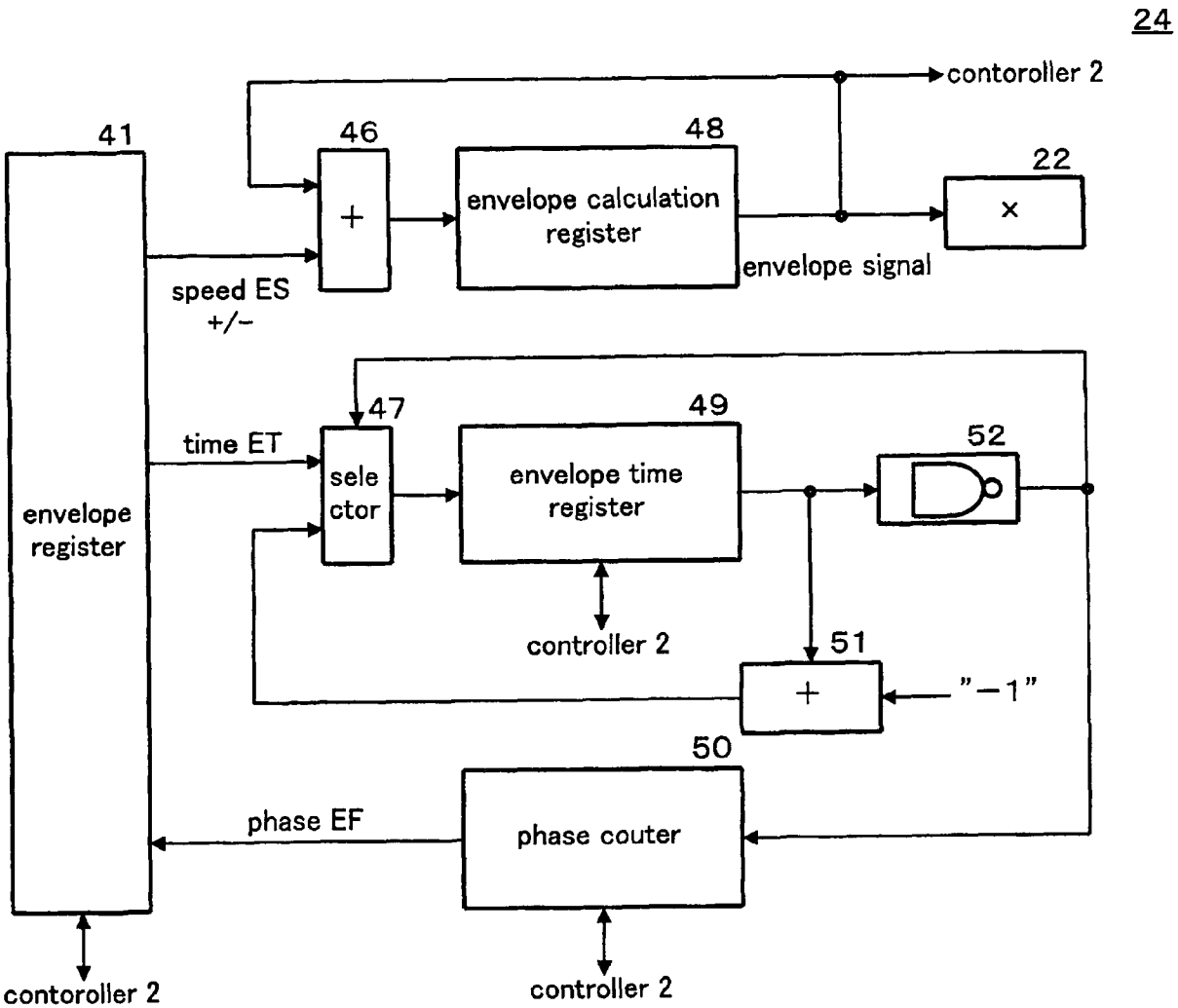
FIG. 3 shows one of envelope generators 24.

FIG. 3 shows one of the envelope generators 24 . . . . Envelope speed data ES of envelope register 41 is calculated and accumulated one after another by adder 46 and envelope operation register 48, envelope operation data EN is calculated, and they are sent to multiplier 22 as envelope signals.

Envelope time data ET of envelope register 41 is decreased by "1" one after another on envelope time register 49 and adder 51 and when the data reaches "0", NAND gates 52 detect the "0" data and send phase end signals. The phase end signals respectively indicate the end of every phase of the envelope such as attack, decay, sustain and release.

The phase end signal is sent to phase counter 50, which counts an increment of "1". Phase counter 50 counts phase EF of the envelope. Controller 2 resets/clears phase counter 50 at the time of on-event/starting operation of sound and at the time of off-event/stopping operation of sound. At the same time envelope speed data ES and envelope time data ET are synthesized and rewritten at envelope register 41.

Envelope phase data EF is sent from phase counter 50 to envelope register 41 as address data, which reads and writes in envelope speed data ES and envelope time data ET of every phase. The phase end signal is sent to selector 47, which changes the envelope time data ET to that of the next phase.

A level/synthesis ratio of the envelope signal changes from "0" to a certain value at each of the attack, decay, sustain and release phases. When the component tone signal is unnecessary to the synthesized tone, the envelope speed data ES shows the value of "0".

Component tone signals are unnecessary to synthesized tones when the component tone signal is not a component of the synthesized tone, before the on-event/starting operation of the synthesized tone and after the off-event/stopping operation of the synthesized tone when the envelope has completely attenuated.

When the envelope speed data ES shows the value of "0", AND gates disposed at the feeding section of envelope generators 24 . . . are inhibited and the output of envelope generators 24 . . . may become "0".

(5) Component Tone Envelope Table 31

Figure 4:
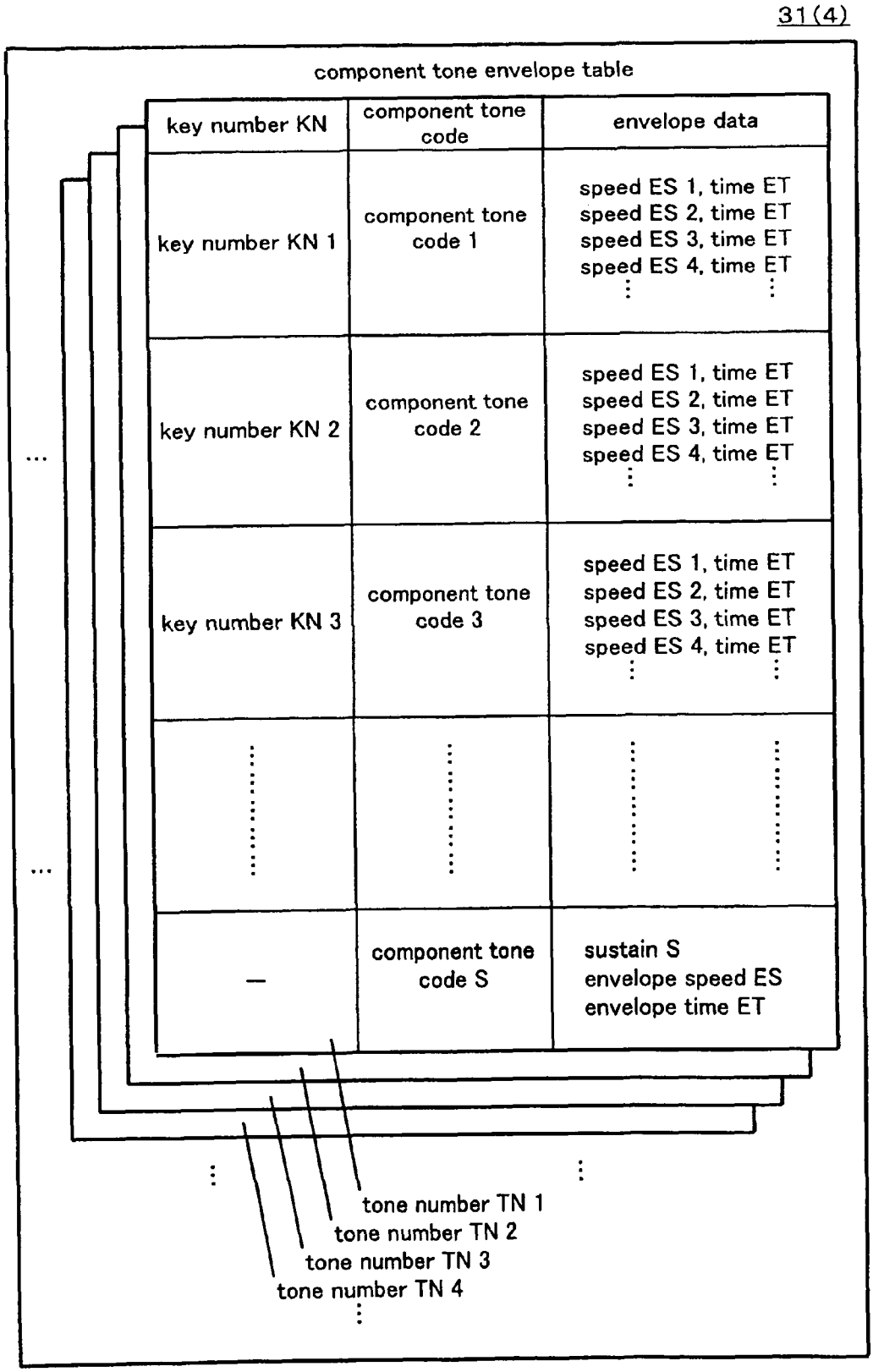
FIG. 4 shows table 31 of component tone envelopes inside program/data storage unit 4.

FIG. 4 shows component tone envelope table 31 in program/data storage unit 4. Component tone envelope table 31 stores timbres/tone number data TN, pitches/key number data KN, envelope data and code data of each component tone, and convert and read data of necessary component tones from the tone number data TN and the key number data KN.

Envelope data of each component tone is sent to all the one hundred and eight envelope generators 24 . . . . Each envelope data is stored at envelope register 41 in envelope generators 24 . . . . The envelope data includes envelope speed data ES and envelope time data ET of the above stated each phase.

Envelope speed data ES shows a step value per one envelope cycle calculated digitally. Envelope time data shows time for calculating the envelope of each phase/the generation time of the envelope of each phase/the sounding time of each phase, that is, a number of times of the above digital calculation for each phase. The envelope signal/level of waveforms/synthesis ratio/amplitude calculated by the envelope speed data ES and the envelope time data ET show quantity of generation of each component tone signal.

A level/synthesis ratio of the envelope signal changes from "0" to a certain value at each of the attack, decay, sustain and release phases. When the component tone signal is unnecessary to the synthesized tone, the envelope speed data ES shows the value of "0" or the envelope time data ET also shows the value of "0".

The above stated component tone data shows which of all the numerous component tone signals are to be synthesized and which are not. It also shows which component tone signals fed from component tone generators 21 . . . are to be used for synthesizing tones. For example, component tone data has the number of bits corresponding to one hundred and eight component tone generators 21 . . . , and refers component tone generators 21 . . . to be used as "1" and component tone generators 21 . . . not to be used as "0". Accordingly a part or all of the component tone signals are commonly shared by a plurality of keys on keyboard 11.

Component tone envelope table 31 stores sustain data. The sustain data are envelope speed ES and envelope time ET of the sustain part at the ending of the envelope when the sustain effect is added. The data are read and used when sustain switch 17 is turned on.

The envelope speed ES and the envelope time ET of the sustain part are stored respectively for each tone number data TN. The data may be stored respectively for each key number data KN, or a single data may be shared by all the tone number data TN and key number data KN.

For sustaining, the component tone code data is also stored. The component tone code data is different from those of the same tone number data TN/the same key number data KN. The different component tone code data is sent to component tone generators 21 . . . at the start of sustain after the off-event.

Accordingly while sustaining, some or all of the component tone signals whose level/synthesis ratio has been initially "0" gradually change their level/synthesis ratio to get the sustain level value which is not "0", then gradually approaching to "0" along with the gradual attenuation of the sustain. As a result, some timbre components which are not included before the sustain can be added so as to make the sustain effect more distinct.

The timbre components added to the sustain are lower tones than those in the attack and the decay. The lower tone components are integral multiple, approximately integral multiple or non-integral multiple of frequencies of the attack or the decay.

Stored also in the gradually attenuating sustain state are the component tone code data/synthesis information showing which of the above numerous component tone signals are to be synthesized and which are not.

(6) Overall Processes

Figure 5:
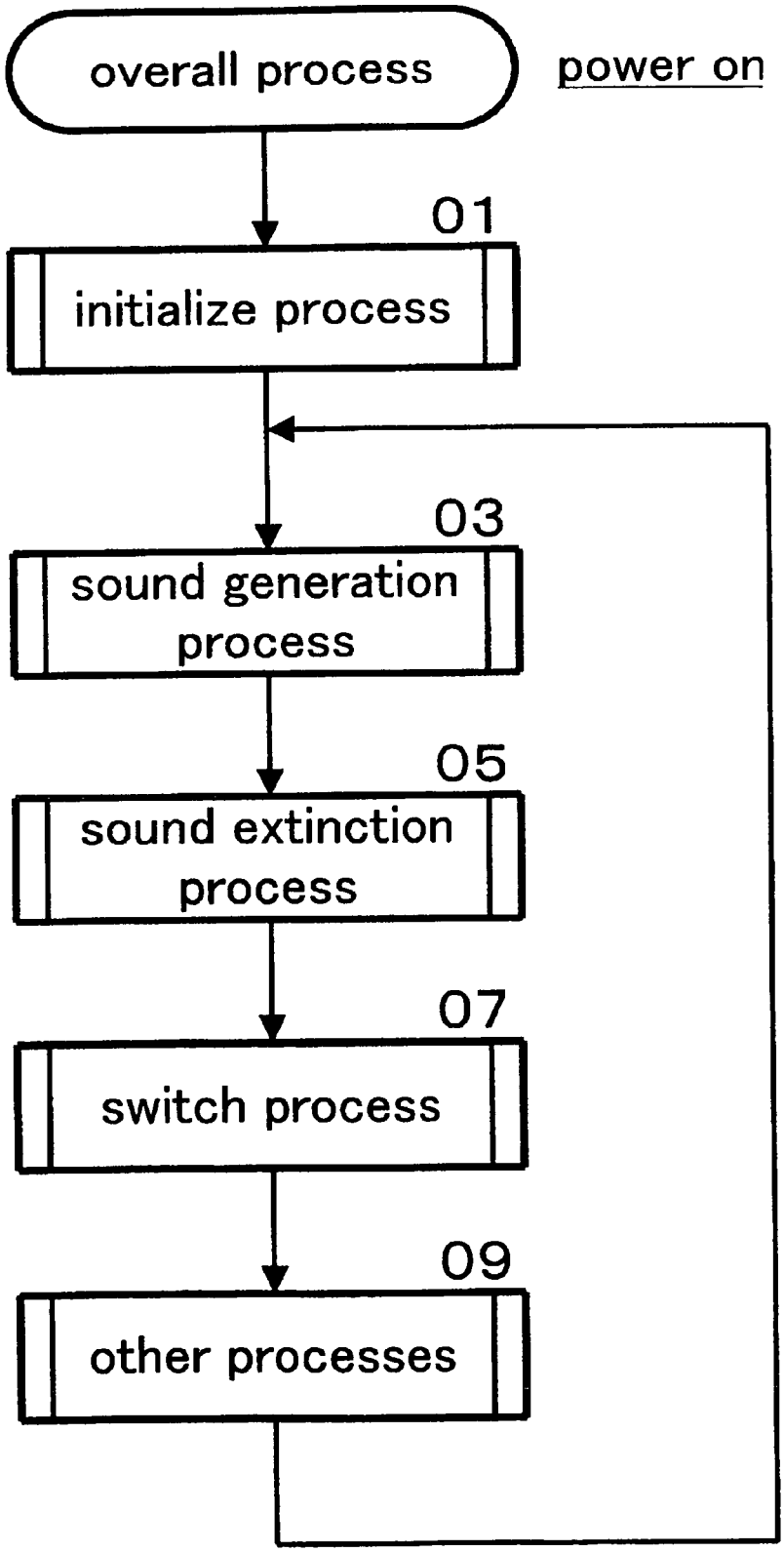
FIG. 5 shows a flowchart of all the processes executed by controller (CPU) 2.

FIG. 5 shows a flowchart of the overall processes executed by the controller (CPU) 2. The overall processing starts as the power source of the tone generation apparatus is turned on, and is repetitively executed until the power source is turned off. First a variety of initialize processing such as initializing the program/data storage unit 4, etc. are executed (step 01).

In the initializing process, the envelope speed data ES "0" is written into envelope register 41 . . . of all the envelope generator 24 . . . and the level/synthesis ratio of all the envelopes is made "0". Then the sounding process responsive to the on-event is carried out according to the manual play or automatic play on keyboard 11 or MIDI circuit 15 (step 03).

In the sounding process, the envelope data of each component tone is read from component tone envelope table 31 and is sent to envelope generator 24 . . . , and a tone starts to be generated. The content of the tone is determined by the musical factor information such as the performance information/tone generation information and the tone control information from keyboard 11 or MIDI circuit 15 and the musical factor information already stored at program/data storage unit 4.

Then the sounding-off/attenuation processes responsive to the off-event are carried out according to the manual play or automatic play on keyboard 11 or MIDI circuit 15 (step 05). In the sounding-off/attenuation processes, all the phases of all the envelopes of all the component tones related to the sounding-off are released. If sustain switch 17 is on at that time, the release is turned into the sustain state.

By the operation of MIDI circuit 15 or panel switch group 13, the musical factor information corresponding to the switches are taken in and are stored in program/data storage unit 4 so as to change the musical factor information (step 07). Then other processes are carried out (step 09) and the processes are repeatedly executed from the step 03 through the step 09.

At step 07 if sustain switch 17 is on, the sustain flag of the register (not shown in the figs.) of program/data storage unit 4 is set as "1". If sustain switch 17 is off, the sustain flag of the register of program/data storage unit 4 is cleared as "0".

(7) Sounding on Processes

Figure 6:
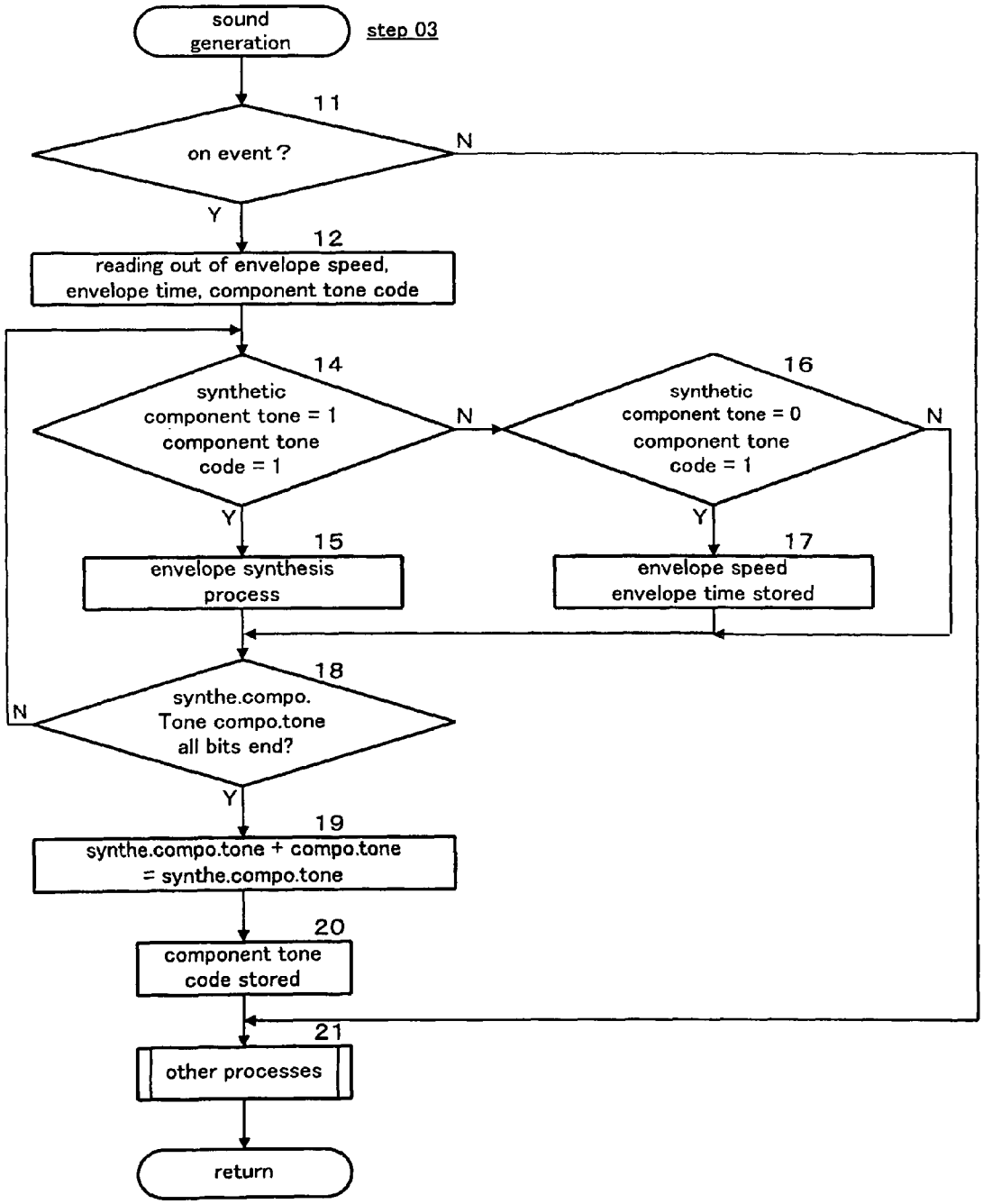
FIG. 6 shows a flowchart of processes of starting tones in the step 03.

FIG. 6 shows a flowchart of the sounding on processes at step 03. When the on-event takes place (step 11), according to the component tone envelope table 31, such data are read as envelope speed data ES, envelope time data ET and component tone code data corresponding to tone number data TN and key number data KN of the tones related to the on-event (step 12).

Then each bit of synthesized component tones stored in program/data storage unit 4 is compared with each bit of the component tone code data which have been read. If both of the bits are found to be "1", envelope speed data ES and envelope time data ET of the component tones corresponding to the bits are rewritten to the data ES and ET of the synthesized envelope (step 15).

The synthesized envelope is a composition of an envelope of a single component tone or a synthesized component tone generated from envelope generator 24 and the newly added component tone. The envelope synthesizing processes in step 15 are described later. The bits of the synthesized component tone code data and the bits of the component tone code data respond to the formerly mentioned one hundred and eight component tone generators 21 . . . and envelope generators 24 . . . .

If the bit of the synthesized component tone code data is "0" and the bit of the component tone code data is "1" (step 16), the envelope speed data ES and the envelope time data ET read at the step 12 are stored at envelope register 41 of envelope generators 24 corresponding to the bits as mentioned above (step 17).

If the bit of the synthesized component tone code data is "1" or "0" and the bit of the component tone data is "0" (step 14,16), no further processing takes place. Processes to synthesize envelopes or to start generating envelopes as described above are repeated for other component tones, that is, the same processes are repeated for the other bits of synthesized component tone code data and other bits of component tone code data (step 18).

Then each bit value of the component tone code data read at step 12 is logically added or operated into each bit value of the synthesized component tone code data in program/data storage unit 4, and the result becomes the above mentioned synthesized component tone code data (step 19). The component tone code data which have been read as described above are stored at program/data storage unit 4 (step 20) and the next processing is carried out (step 21).

Accordingly the bits of the synthesized component tone code data responsive to envelope generators 24 . . . which are generating synthesized envelopes become "1" and the other bits become "0".

At the time of on-event, synthesized envelope speed data ESs and synthesized envelope time data ETs of the synthesized component tones a+b are rewritten and replaced by new synthesized envelope speed data ESs and synthesized envelope time data ETs of the envelopes resulting from the new on-event. Therefore envelope signals of component tones having the same frequency are synthesized to generate one tone at the time of on-event.

Thus when there are at least two sounding operations, at the start of the latter operation if the signal of the component tone which has been sounding and that which has just started sounding both give synthesis information to direct to "synthesize" (step 14), the synthesized envelope is formed from those component tone signals (step 15).

Or when there are at least two sounding operations, at the start of the latter operation if the signal of the component tone which has been sounding gives synthesis information to direct "not to synthesize" and the signal of the component tone which has just started sounding give synthesis information to direct to "synthesize" (step 16), tones will be generated by the envelope of the component tone signal which has started to generate the tone (step 17).

Or when there are at least two sounding operations, at the start of the latter operation if the signal of the component tone which has been sounding gives synthesis information to direct "not to synthesize" or to "synthesize", and the signal of the component tone which has just started sounding gives synthesis information to direct "not to synthesize" (steps 14, 16), no further processes are executed.

Every time the synthesized envelope is formed (step 15), the synthesis information of the component tone signal which has been generating a tone is renewed (step 19). Every time a tone starts to be generated by the envelope of the component tone signal which has started to generate a tone (step 17), the synthesis information of the component tone signal which has been generating a tone is renewed (step 19).

(8) Sounding Off Processes

Figure 7:
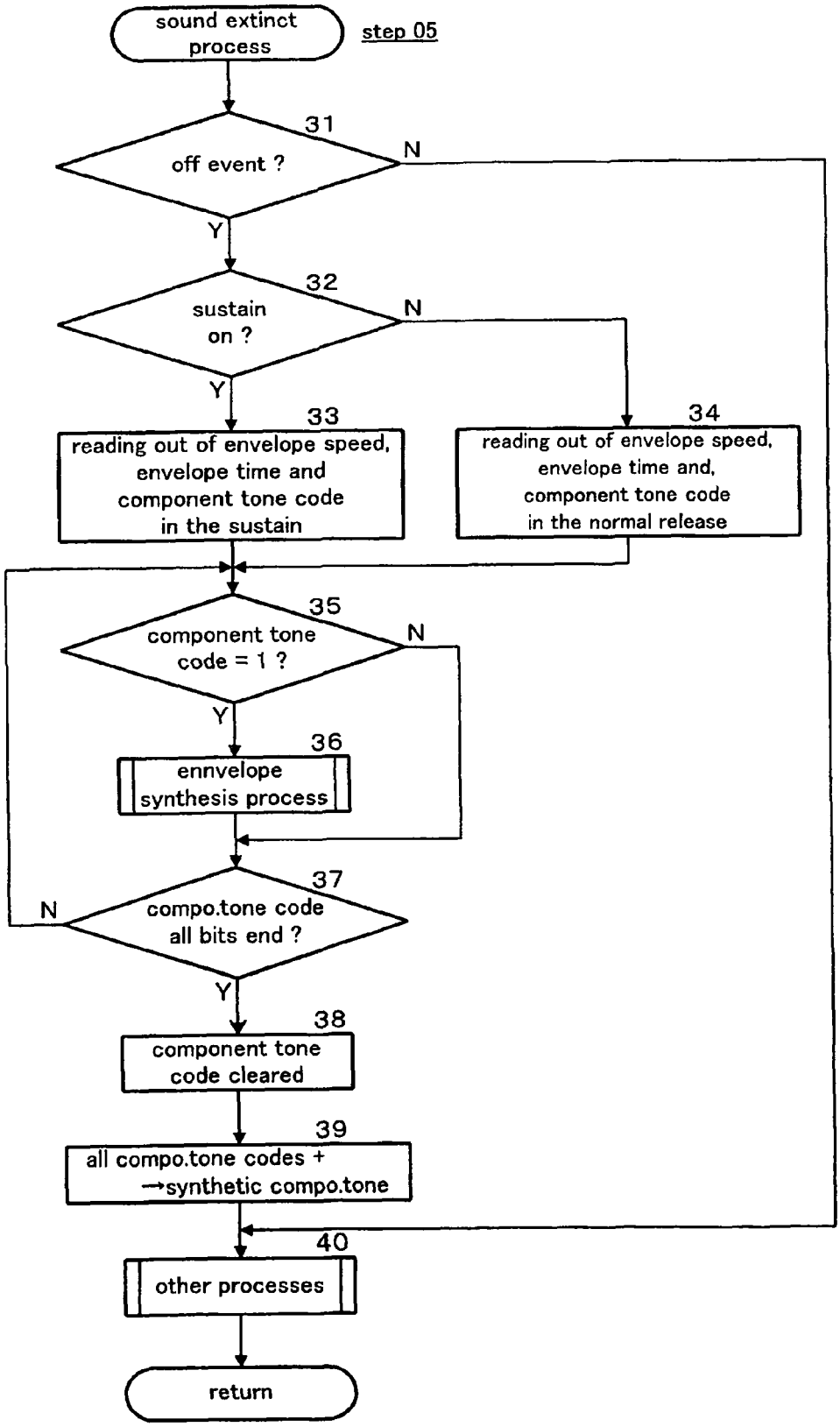
FIG. 7 shows a flowchart of processes of stopping tones in the step 05.

FIG. 7 shows a flowchart of sounding off processes at step 05 when an off-event takes place (step 31) and if sustain switch 17 is turned on and the sustain flag is at "1" (step 32), the envelope speed data ES, the envelope time data ET and the component tone code data of the sustain are read out corresponding to tone number data TN of tones relative to the off-event based on component tone envelope table 31 (step 33).

And if sustain switch 17 is turned off and the sustain flag is at "0" (step 32), the envelope speed data ES, the envelope time data ET and the component tone code data of the release are read out corresponding to tone number data TN and key number data KN of tones relative to the off-event based on component tone envelope table 31 (step 34).

Then according to the "1" bit of the component tone code data, envelope speed data ES and envelope time data ET of the release phase or the sustain phase of the component tone's envelope are rewritten into those of synthesized envelope (steps 35, 36).

To synthesize the envelope, the envelope of the release phase or the sustain phase of the component tones relative to the key-off is added to (actually subtracted from) the synthesized envelope of a single component tone or a synthesized component tone which has already been generated from envelope generator 24. Processes to synthesize the envelope at step 36 are described later. The bit of each synthesized component tone code data and that of each component tone code data correspond to one hundred and eight component tone generators 21 . . . and envelope generators 24 . . . .

The above processes to synthesize the envelope or to start ending the envelope is repeatedly executed for other component tones, that is, for other bits of component tone code data (step 37).

At step 20, program/data storage unit 4 has stored component tone code data. Among them such data are deleted that are the same as the component tone data which have been read at steps 33 and 34 (step 38). Each of the bit value of the remaining component tones is logically added or operated, and the result becomes the synthetic component tone code data as described above (step 39), and the other processes are executed. (step 40)

As a result these processes eliminate, from the envelopes generated from envelope generators 24 . . . , such envelopes as have entered into a release or sustain phase, and determine as "1" the bit of synthetic component tone code data corresponding to some of envelope generators 24 . . . that are still generating synthetic envelopes, and determine the other bits as "0".

At the time of the off-event, the synthetic envelope speed data ESs and the synthetic envelope time data ETs of the synthetic component tones a+b are rewritten and are replaced by the synthetic envelope speed data ESs and synthetic envelope time data ETs of the envelope incorporating the new release or sustain phase. Therefore also at the off-event, envelope signals are synthesized incorporating component tones of the same frequency, and generate one tone.

Thus when there are at least two sounding operations, at the end of the earlier operation if the signal of the component tone which has been sounding gives synthesis information to direct "not to synthesize" or to "synthesize", and the signal of the component tone which has just stopped sounding gives synthesis information to direct to "synthesize" (step 35), the synthesized envelope is formed from those component tone signals (step 36). Every time the synthesized envelope is formed (step 36), the synthesis information of the component tone signal which has been generating a tone is renewed (step 39).

When sustain switch 17 is turned on, the sustain state starts at the end of the former of at least two sounding operations. IF the signal of the component tone which has been sounding gives synthesis information to direct "not to synthesize" or to "synthesize", and the signal of the component tone which has just stopped sounding gives synthesis information to direct to "synthesize" (step 35), the synthesized envelope is formed from those component tone signals (step 36). Every time the synthesized envelope is formed (step 36), the synthesis information of the component tone signal which has been generating a tone is renewed (step 39).

Thus while a plurality of keys on keyboard 11 have been operated for sounding at the same time and some of them turn to be operated for sounding-off, the waveforms of the envelopes or the synthetic envelopes are maintained not to enter the release state as to component tone signals which are not relative to the sounding-off operation. The envelope waveforms of the component tone signals relative to the sounding-off operation are only to enter the release state.

As a result if one key on keyboard 11 is operated for sounding-off, all the component tone signals commonly shared by a plurality of keys do not get the envelopes into the release state, component tones controlled by other instructions than stop sounding do not get released, and one operation to stop sounding does not cause change of components of the other keys' tones.

If one key on keyboard 11 is operated for sounding-off, all the component tone signals commonly shared by a plurality of keys do not get the envelopes into the release state. Therefore sustain is able to be provided to a plurality of keys. The same thing is available especially for draw-bar style organs/keyboard instruments.

(9) Envelope Synthesis Processes

Figure 8:
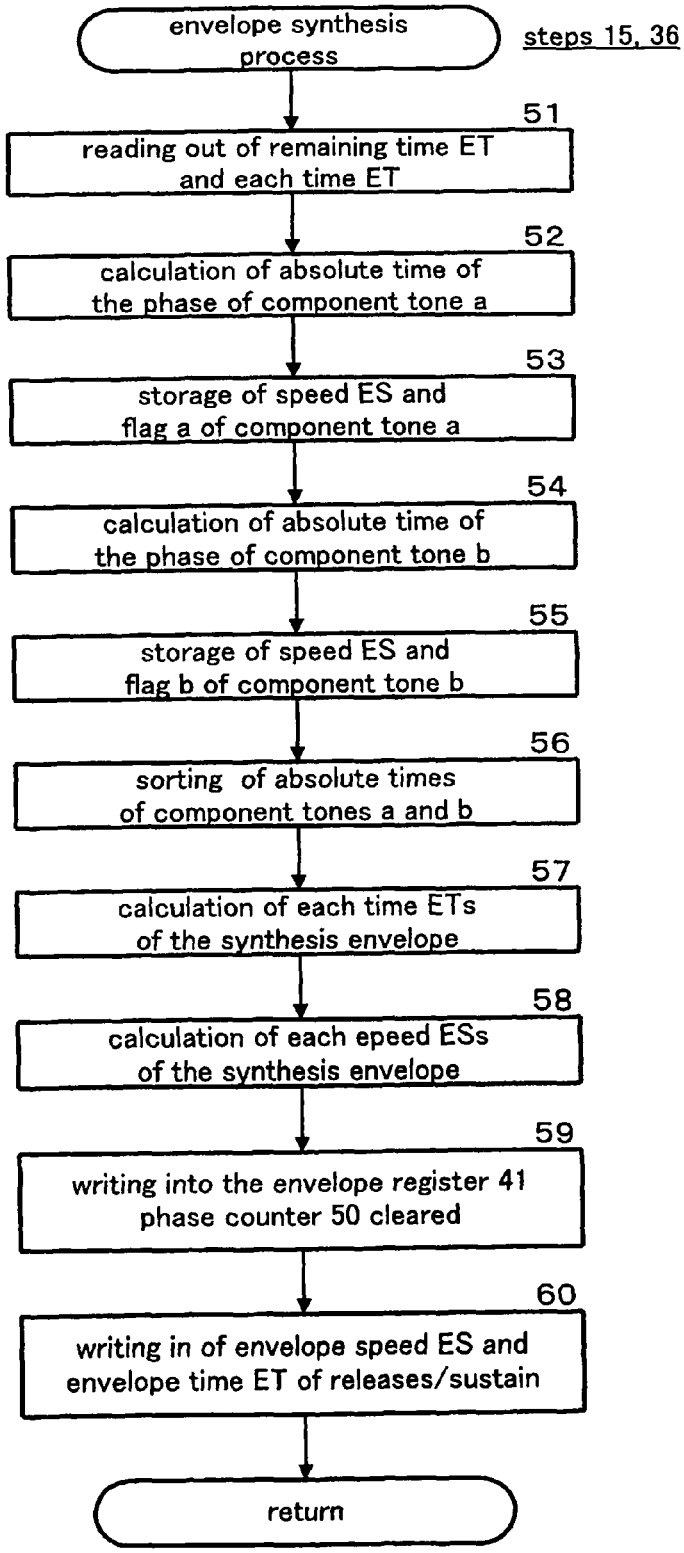
FIG. 8 shows a flowchart of processes of synthesizing the envelopes in the steps 15 and 34.

FIG. 8 shows a flowchart of envelope synthesis processes at steps 15 and 36. First, controller 2 reads the phase value counted by phase counter 50 and the remaining envelope time data ET of envelope time register 49 (step 51). The remaining envelope time data ET is accumulated to the envelope time data ET of the rest of the phases in sequence and the absolute time from the present moment to the end of each phase of the component tone a is found out (step 52).

Figure 9:
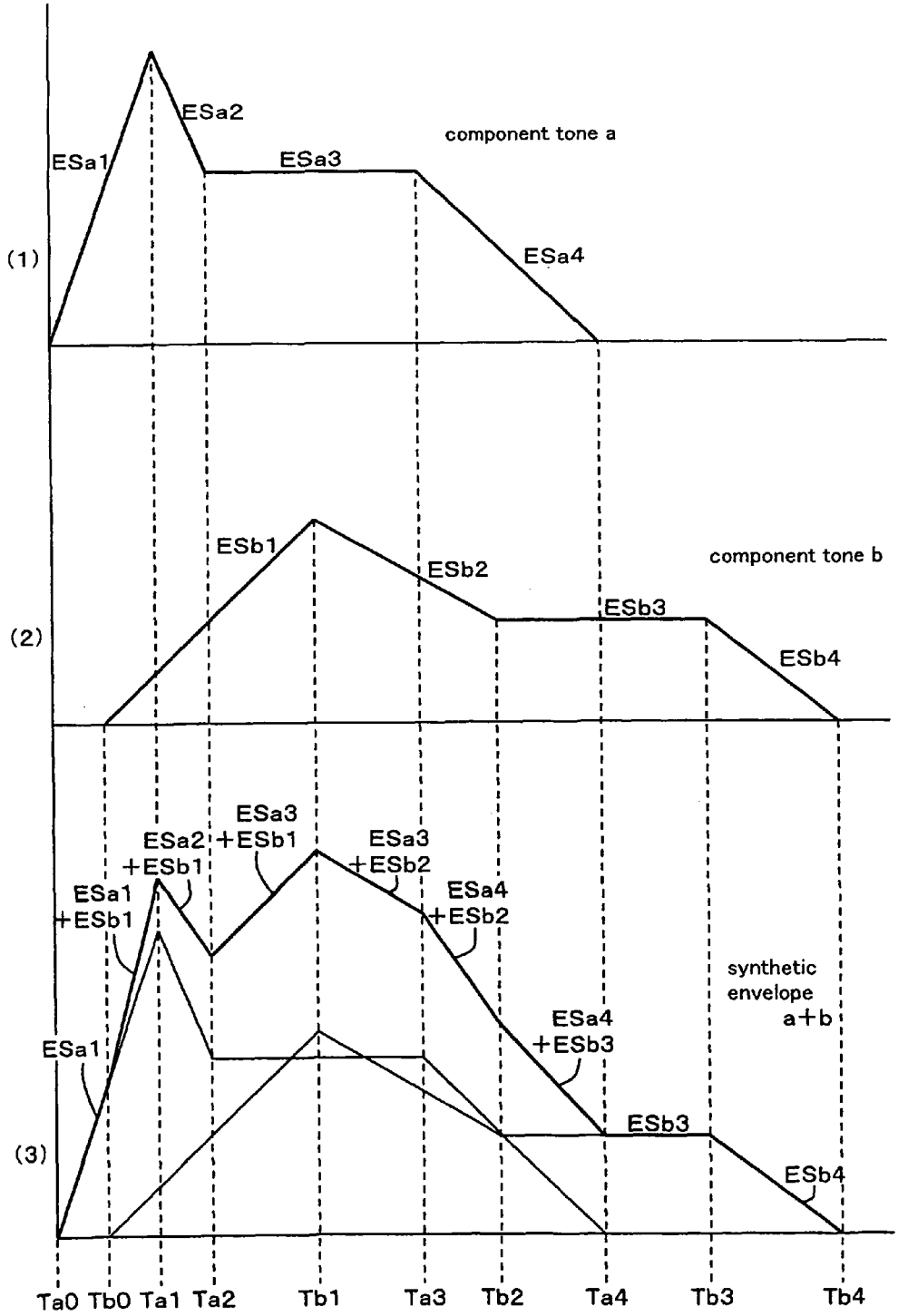
FIG. 9 shows an example of a waveform of an envelope synthesized from component tones a and b of the same frequency.

FIG. 9 shows the following. The components tone a starts sounding (Timing Ta0). A component tone b starts sounding (Timing Tb0). Then the attack phase of the component tone a is finished (Timing Ta1) followed by ending of decay of the component tone a (Timing Ta2). The attack of the component tone b is finished (Timing Tb1). Sustain of the component tone a is finished (Timing Ta3). Decay of the component tone b is finished (Timing Tb2). Release of the component tone a is finished (Timing Ta4). Sustain of the component tone b is finished (Timing Tb3) and release of the component tone b is finished (Timing Tb4).

In this condition, the remaining time data ET becomes (Ta1−Tb0), and the accumulated values as a result of calculating the envelope time data of the rest of the phases become (Ta2−Tb0), (Ta3−Tb0), (Ta4−Tb0) The envelope time data ET of each of the phases shows time between each timing such as Ta0, Ta1, Ta2, Ta3 and Ta4. Therefore accumulating the envelope time data ET of the rest of the phases will find out time from the start of sounding the component tone b to each timing Ta1, Ta2, Ta3 and Ta4.

Also stored are the envelope speed data ES of the component tone a at the phase just before each timing and a flag a ("1") identifying the component tone a corresponding to each absolute time (Ta2−Tb0) (Ta3−Tb0) and (Ta4−Tb0) (step 53).

Then the absolute time from the present moment to the end of each phase of the component tone b is found out as a result of accumulating in sequence the envelope time data ET of the rest of the phases to the remaining envelope time data ET (step 54). Absolute time is similarly found out by (Tb1−Tb0) (Tb2−Tb0) (Tb3−Tb0) and (Tb4−Tb0).

Also stored are the envelope speed data ES of the component tone b at the phase just before each of the timing and a flag b("0" ) identifying the component tone b corresponding to each of the absolute time (Tb1−Tb0) (Tb2−Tb0) (Tb3−Tb0) and (Tb4−Tb0) (step 55).

The timings Ta3 and Tb3 are both the off-event timing/sounding-off timing. The timings Ta4 and Tb4 are both shifted in accordance with the off-event timing. Therefore the absolute times (Ta3−Tb0) (Ta4−Tb0) (Tb3−Tb0) and (Tb4−Tb0) are not determined by the on-event timing/sounding-on timing.

However the absolute time is determined when the sounding-off does not change the envelope form. The absolute times (Ta3−Tb0) (Ta4−Tb0) (Tb3−Tb0) and (Tb4−Tb0) are determined at the time of sounding-off as stated above. Therefore the absolute time to the end of the sustain of each component tone will be the largest value possible and the envelope speed data ES will be "0".

When the component tone a is in the release state (including the state added with the sustain effect) and the component tone b starts sounding, the absolute time is able to be found out, because the sounding-off operation of the component tone b has already been completed, which makes the timing of ending the release state very clear.

The absolute times determined at step 22 to 25, (Ta2−Tb0) (Ta3−Tb0) (Ta4−Tb0) (Tb1−Tb0) (Tb2−Tb0) (Tb3−Tb0) and (Tb4−Tb0), are arranged from the longest to the shortest, and the corresponding envelope speed data ES are arranged in the same order (step 56). Accordingly the timings shown in FIG. 9 (3) are sorted in order.

When a plurality of keys on keyboard 11 have been operated for sounding at the same time and some of them turn to be operated for sounding-off, among the component tone signals common to the keys, the envelope or synthetic envelope waveform of the component tone signals which are not relative to the sounding-off operation are maintained not to enter the release state. The envelope waveforms of the component tone signals relative to the sounding-off operation are only to enter the release state.

Accordingly if one key is operated for sounding-off on keyboard 11, all the component tone signals common to a plurality of keys do not get the envelopes into the release state, component tones which are not to be controlled by the sounding-off operation of the key do not get released, and one key operation for sounding-off does not change components of other keys' tones.

If one key is operated for sounding-off on keyboard 11, all the component tone signals commonly shared by a plurality of keys do not get the envelopes into the release state. Therefore the sustain state is maintained for a plurality of keys. The same effect is available especially to draw-bar style organs/keyboard instruments.

FIG. 10 (1) shows absolute times, the envelope speed data ES and the component tone flags sorted in this way. The data here correspond to the synthetic envelope signals of FIG. 9 (3).

Then from the absolute times (Ta2−Tb0) (Ta3−Tb0) (Ta4−Tb0) (Tb1−Tb0) (Tb2−Tb0) (Tb3−Tb0) and (Tb4−Tb0), the absolute time just before each of them is subtracted (step 57).

As a result, as shown in the left column of FIG. 10 (2), the subtraction determines the synthetic envelope time data ETs of the new phase between the timing of each synthetic envelope signal shown in FIG. 9 (3). The first synthetic envelope time data ETs is totally a copy of the first absolute time (Ta2−Tb0).

Envelope speed data ES corresponding to each absolute time is added and synthesized by data ES which is envelope speed data ES of the preceding absolute time and possesses a flag different from its own component tone flag a, b (step 58).

As a result, envelope speed ES of the component tones a and are added and synthesized at every phase shown in FIG. 9 (3), and the synthetic envelope speed data ESs of the new phase between the timing of each synthetic envelope signal shown in FIG. 9 (3) is determined as shown in the right column of FIG. 10 (2).

Envelope register 41 of envelope generator 24 writes the synthetic envelope time date ETs and the synthetic envelope speed data ESs of each phase of the synthetic envelope signals which have been determined in this way, and phase counter 50 is cleared (step 59).

Then the generation of a synthetic envelope starts. At that time envelope register 41 of envelope generator 24 stores and generates the portions of the synthetic envelope after the timing of the on-event or the off-event.

Thus envelope speed data ES and envelope time data ET of the component tone a are rewritten every time a new component tone b having the same frequency is generated, and they are replaced by synthetic speed data ESs and synthetic envelope time data ETs of the envelope in which the new component tone b is synthesized.

Therefore the volumes (levels) of generation of component tones having the same frequency are synthesized and united into one generation. The envelope signals of component tones having the same frequency are synthesized and united into one generation.

Then envelope register 41 of envelope generator 24 for the component tone a stores envelope speed data ES and envelope time data ET of the component tone a after it is released, and also envelope register 41 of envelope generator 24 for the component tone b stores envelope speed data ES and envelope time data ET of the component tone b after it is released (step 60). The envelope speed data ES and the envelope time data ET after the release are processed at the envelope synthesis processing after the off-event mentioned above.

Thus when at least two component tones a and b are sounding simultaneously but the timings of operations of sounding on and off are not simultaneous, envelopes of the respective component tone signals are synthesized into one envelope to become a synthetic envelope of each component tone signal at the start of the latter sounding operation or at the end of the former sounding operation.

The number of envelopes synthesized may not be limited to two as shown in FIG. 9 but may be three or more. In such a case, processes shown in FIG. 6 through FIG. 8 are similarly executed and the synthetic envelopes are calculated at every start timing besides the first sounding and at every end timing besides the last sounding.

Also in such a case, when a plurality of keys on keyboard 11 have been operated for sounding and some of the keys stop sounding, the waveforms of envelopes or synthetic envelopes of component tone signals which are not relative to the sounding-off operation are not released but maintained. Only the envelope waveforms of the component tone signals relative to the sounding-off operation are released.

(10) Envelope Synthesis Processes at the Sustain State

Figure 11:
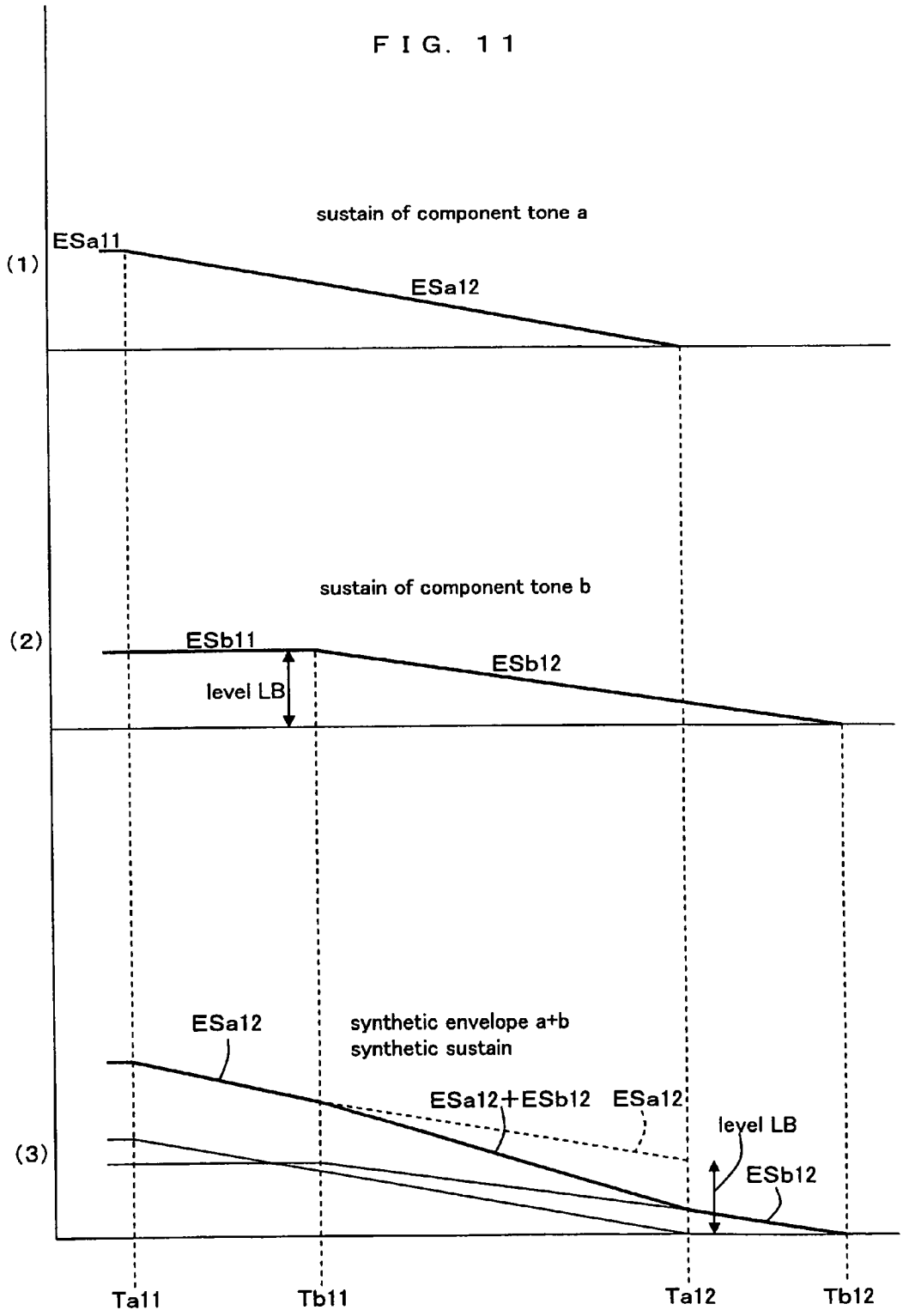
FIG. 11 shows an example of a waveform of an envelope synthesized from component tones a and b of the same frequency in the sustain state.

FIG. 11 shows an example of an envelope waveform as a result of synthesizing the component tones a and b of the same frequency. When the component tone a stops sounding first at the timing Ta11, the synthetic envelope is re-synthesized according to envelope speed data ES and envelope time data ET of the component tone a at the sustain state (steps 51~60). The re-synthesized envelope signal does not stay at the hold level/synthetic ratio (Esb11) of the component tone b, which is "0", but is gradually attenuated toward the limited level "Lb".

After the end of the first sounding operation, the level/ratio of the synthesized envelope gradually approaches the envelope level of the synthesized tones which have not been stopped yet (i.e. the hold, attack or decay level).

Next when the component tone b is stopped at the timing of Tb11, the synthetic envelope is re-synthesized according to envelope speed data ES and envelope time data ET of the component tone b at the sustain state (steps 51~60) As a result the re-synthesized envelope signal is gradually attenuated toward the level "0".

If the component tone b is not stopped, the synthesized envelope signal reaches the hold level/the above envelop level of the component tone b and then the hold level is maintained. If the component tone b is stopped after that, the re-synthesized envelope signal is gradually attenuated toward the level "0".

If sustain switch 17 is turned off from on between the note-off of the component tones a and b, off-events do not occur during this period (step 31). Therefore the envelope of the component tone a is not rewritten and the sustain state of the component tone a is maintained.

However, at the note-off of the component tone b, the sustain state is removed. (step 32→34) The envelope data of the sustain is not read (step 33) but envelope data of the normal release state is read. (step 34) Therefore the sustain state is removed and the normal release state is provided (step 36).

If sustain switch 17 is turned on from off between the note-off of the component tones a and b, off-events do not occur during this period (step 31). Therefore the envelope of the component tone a is not rewritten and the component tone a is not sustained.

However at the note-off of the component tone b, the sustain state is provided. (step 32→33) The envelope data of the sustain is read (step 33) but the envelope data of the normal release state is not read (step 34). Therefore the normal release state is removed and the sustain state is provided (step 36).

When keys have been under sounding operation and some of them are operated to stop sounding during the sustain state of the envelope waveforms of some component tone signals among those shared by some keys, the envelope waveforms or the synthetic envelope waveforms not relative to the key-off operation are kept in the sustain state. The envelope waveforms of the component tone signals relative to the key-off operation are in the sustain or release state.

At that time if sustain switch 17 is turned off from on between the timings Ta11 and Tb11 shown in FIG. 11, the component tone b enters the release state, not the sustain state, but the sustain state of the component tone a continues.

If one key-off operation takes place while tones of other keys are still sustained, the sustain state is not replaced by the release state but is maintained. The same function is available especially draw-bar style organs/keyboard instruments.

The number of envelopes synthesized as shown in FIG. 11 may not be limited to two but may be three or more. In such a case, the processes shown in FIG. 6 through FIG. 8 are similarly executed and the synthetic envelopes are calculated at every start timing besides the first sounding and at every end timing besides the last sounding.

In such a case also, when one key-off operation take place while tone of other keys are still sustained, the sustain state is not replace by the release state but is maintained.

Addition device 66 . . . and multiplication device 62 . . . are combined to determine which of the component tone signals are to be synthesized and which are not, and provide the information on synthesizing similarly to the above stated. At the time of key-on when some other tones have already been sounding if signals of component tones which have been sounding and those which have just started to sound both provide information "to synthesize", the synthetic envelope will be formed from said component tone signals.

At the time of key-on when some other tones have already been sounding if signals of component tones which have been sounding provide information "not to synthesize" and those which have just started to sound provide information "to synthesize", the envelope of the latter signal determines the tone. At the timing of key-on when some other tones have already been sounding if signals of component tones which have been sounding provide information "not to synthesize" or "to synthesize" and those which have just started to sound provide information "not to synthesize", no subsequent processing occurs.

At the time of key-off when other tones are still sounding if signals of component tones which are sounding provide information "not to synthesize" or "to synthesize" and those which have just stopped provide information "to synthesize", the synthetic envelope will be formed from said component tone signals.

When the sustain state starts at the time of key-off when other tones are still sounding if signals of component tones which are sounding provide information "not to synthesize" or "to synthesize" and those which have just stopped provide information "to synthesize", the synthetic envelope of the sustain state will be formed from said component tone signals.

(11) Tone Signal Generator 5 (Second Embodiment)

Figure 12A:
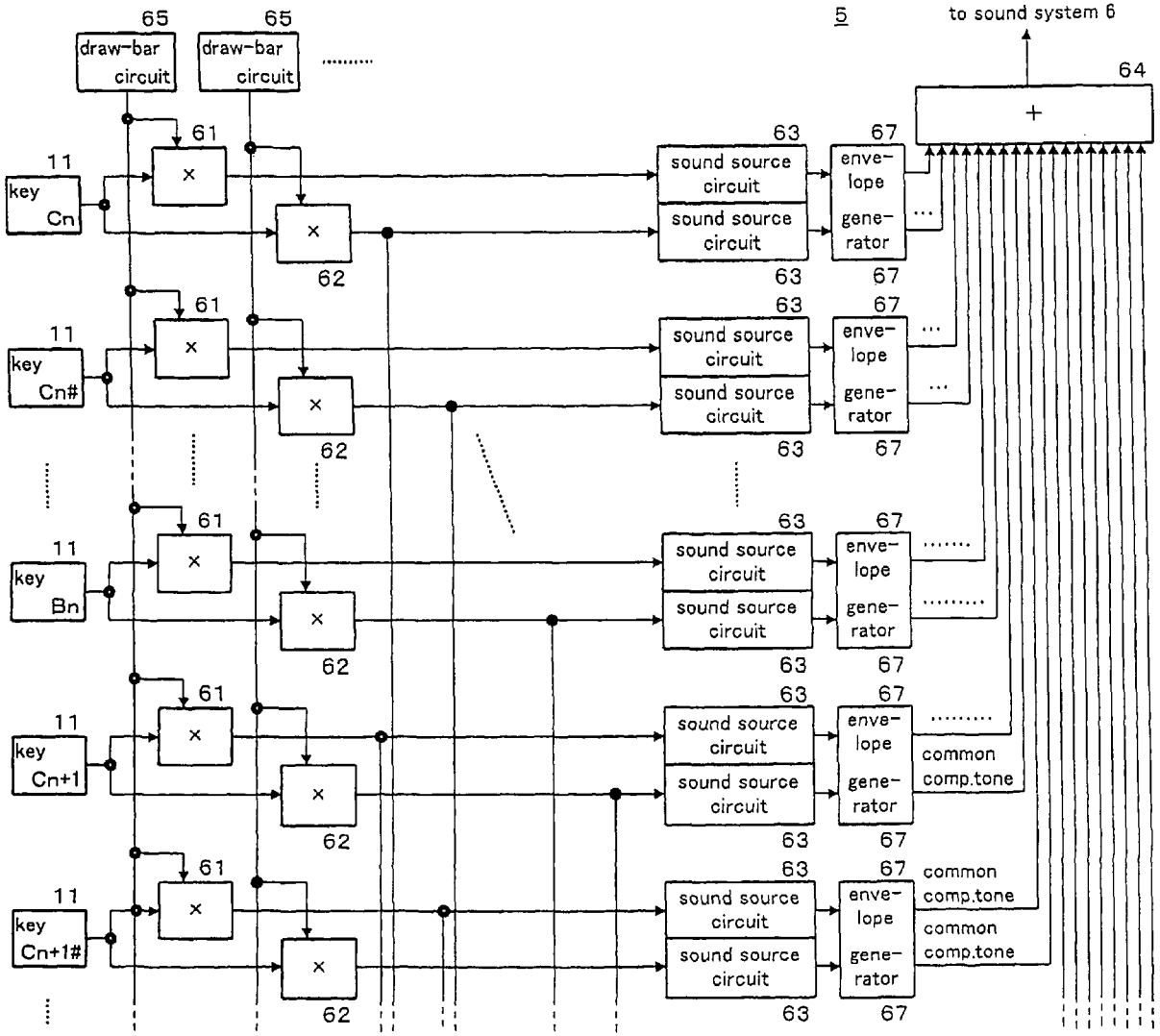
FIGS. 12A and 12B show the second embodiment of the tone signal emitter 5.
Figure 12B:
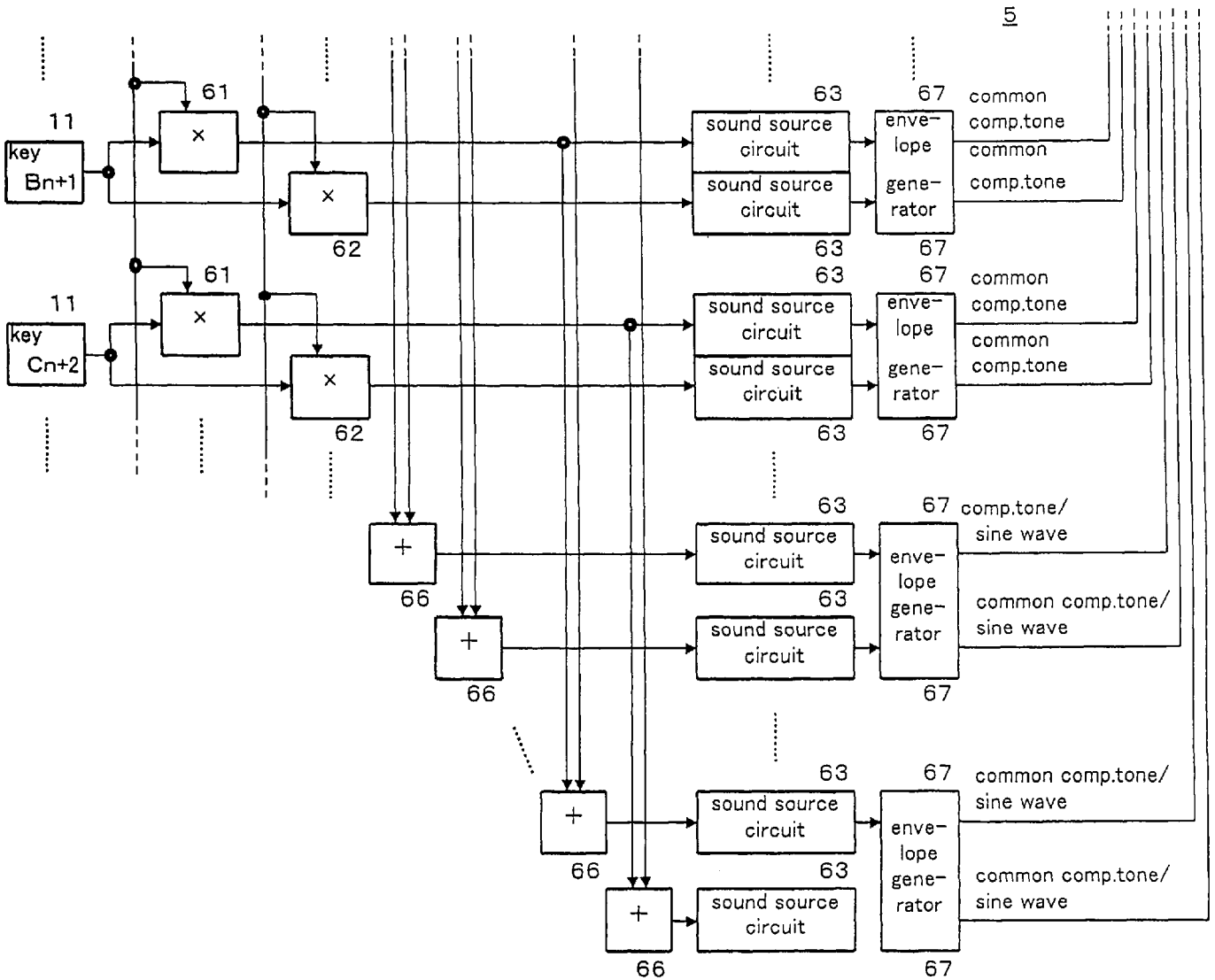

FIG. 12 shows a second embodiment of tone signal generator 5. Tone signal generator 5 uses a draw-bar. A draw-bar system, having a plurality of draw-bars, is a sort of a stop for controlling timbers adopted to electric organs. The draw-bar changes and determines a level/ratio of synthesizing waveforms which have different cycles. Fundamental tones and harmonic tones, for example, have sin waves which have different cycles from each other. And the draw-bar changes and determines the synthesized waveforms.

As for on-data of each key of keyboard 11, the amplitude data is multiplied by multiplication device 61 . . . and multiplication device 62 . . . , and is sent to sound source circuits 63 . . . . The amplitude data is set up at draw-bar circuit 65. Sound source circuits 63 . . . feed sin waves, etc. which have the amplitudes corresponding to the amplitude data and have the same waveforms but different cycles.

Envelope generator 67 synthesizes envelopes of waves such as sin waves with regulated amplitude and different cycles. Addition device 64 calculates and synthesizes them. Draw-bar circuits 65 . . . set up their waveforms, by which timbres are determined and sent to sound system 6.

Every sound source circuit 63 has its own envelope generator 67, that is, envelope generator 67 is disposed for every component tone signal which is common to a plurality of keys. If there is one key-off operation, it does not release all the component tone signals/sine waves which are common to a plurality of keys. If other keys' tones are sustained, the key-off operation does not release the tones but maintains the sustain state.

If the setting of draw-bar circuit 65 . . . is changed, combination or synthesis ratio of component tone signals/sine waves having different frequencies is changed, waveforms of synthesized tones are changed, and then timbres from the synthesized tone waveforms are changed. Accordingly a plurality of keys on keyboard 11 commonly shares a part or all of the component tone signals.

In drawbar circuits 65 . . . , data are fed accordingly to a volume of operation or setting up. The data are sent to multiplication device 61 . . . , multiplication device 62 . . . , . . . , and are multiplied by the on-data of the keys on keyboard 11 to be determined as the above states amplitude. Thus all the waveforms of all the keys' tones are unified into the waveforms determined through draw-bar circuits 65 . . . .

Sound source circuits 63 . . . generates sine waves having different frequencies corresponding to the twelve tones in one octave or 12×n tones in n octaves. Therefore frequencies corresponding to pitches of the respective keys are selected as fundamental tones.

Output from multiplication device 61 . . . , multiplication device 62 . . . , . . . , is sent straight to, or is sent after the adding process by addition device 66 to sound source circuits 63 . . . as amplitude data. This adding process adds the amplitude data of tones with the same pitch name in on or several octave differences. As a result, synthesized are component tones/harmonics integral multiplied, different in one or several octaves.

Envelope generator 67 synthesizes the sine waves, whose amplitudes have been controlled by sound source circuits 63 . . . , and generates the envelope waveforms. The envelope waveforms transform in the course of attack, decay, sustain and release. At the key-off, that is, after the timing of ending the sound generating operation on keyboard 11, the sustain state is switched to the release state.

In the sustain state, the envelope level slowly attenuates. In the release state the envelope level attenuates at a usual speed. Envelope generator 67 may be the same as envelope generator 24.

In order to make the explanation plain, FIG. 12 shows a simple circuit. FIG. 12 shows two draw-bar circuits 65, but there may be three or more draw-bar circuits. Keyboard 11 has twenty four keys in two octaves plus one key, but there may be more keys actually. Accordingly there may be more sound source circuits 63 . . . , multiplication devices 61 . . . , 62 . . . , addition devices 66 . . . .

(12) Envelope Generator 67 (Second Embodiment)

Figure 13:
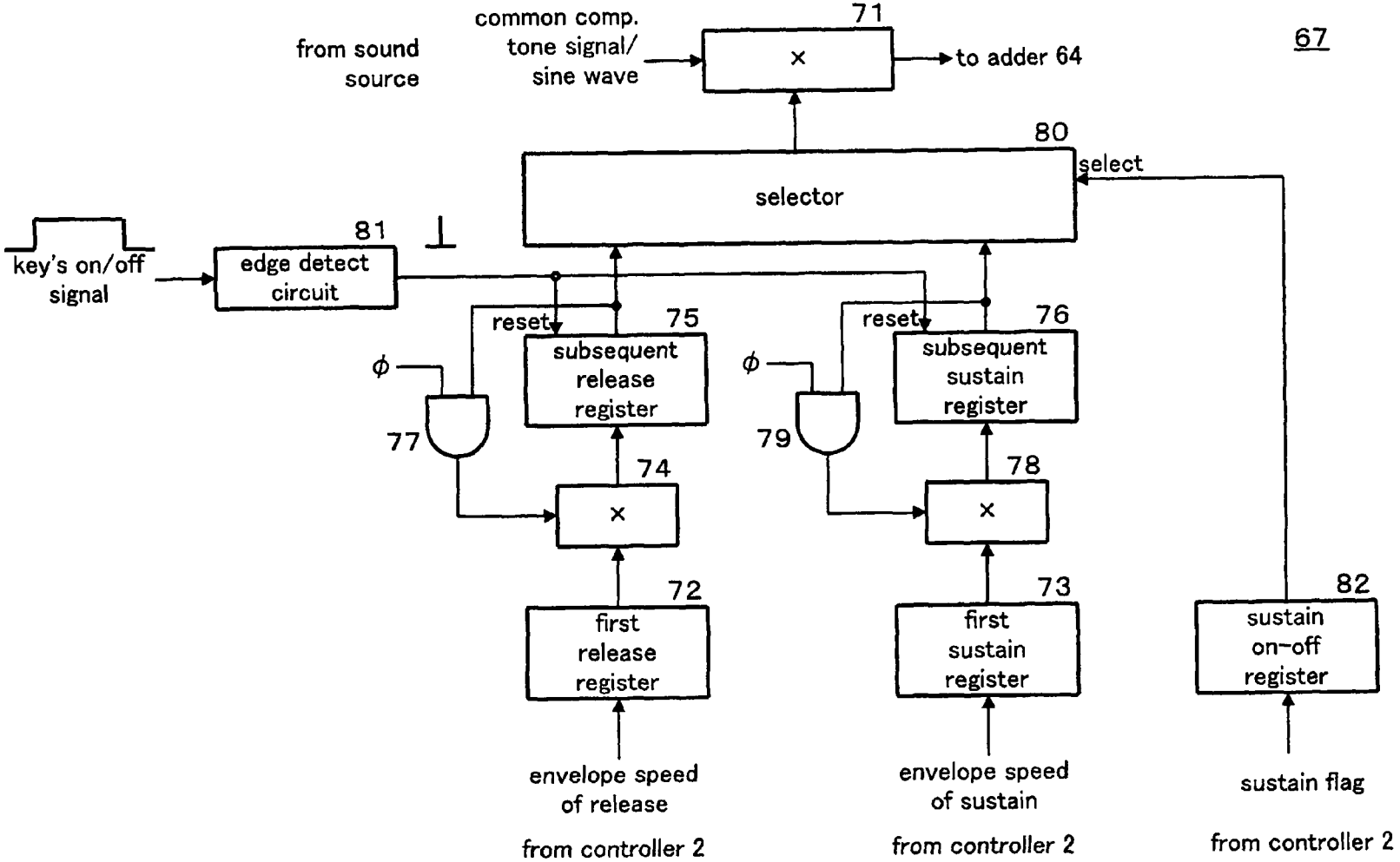
FIG. 13 shows envelope generator 67 of FIG. 12 (the second embodiment).

FIG. 13 shows envelope generator 67 that is also shown in FIG. 12. Multiplication device 71 multiplies envelope waveforms by the sine waves, the amplitude of which has been controlled through sound source circuit 63 . . . , and send them to addition device 64.

The first release register 72 stores the envelope speed data in the release state by controller 2. The first sustain register 73 stores the envelope speed data in the sustain state by controller 2.

The envelope speed data in the release is larger than "0", smaller than "1", close to "0" and produces a rapid attenuation. The envelope speed data in the sustain is larger than "0", smaller than "1", close to "1" and produces a gradual attenuation.

The release envelope speed data in the first release register 72 goes through multiplication device 74 and is stored in the second release register 75. Then it goes through AND gate 77 and is fed back to multiplication device 74. In the process the release envelope speed data is multiplied by another release envelope speed data repeatedly to provide envelope waveforms that are gradually attenuated.

The sustain envelope speed data in the first sustain register 73 goes through multiplication device 78 and is stored in the second sustain register 76. Then it goes through AND gate 79 and is fed back to multiplication device 78. In the process the sustain envelope speed data is multiplied by another sustain envelope speed data repeatedly to form envelope waveforms that are gradually attenuated.

The release envelope data from the second release register 75 goes through selector (multiplexer) 80 to multiplication device 71, which multiplies the sine waves by the data. The sustain envelope speed data from the second sustain register 79 goes through selector (multiplexer) 80 to multiplication device 71, which multiplies the sine waves by the data.

AND gates 77 and 79 are provided with clock signals $\phi$ of determined cycles as enabling signals, and the release or sustain envelope speed data is multiplied by another release or sustain envelope speed data repeatedly at every cycle.

Edge detect circuit 81 detects the down edge of the on/off signal of each key on keyboard 11. Then the detected one shot pulse signal is fed to the second release register 75 and the second sustain register 76 as a reset signal, and the store value is set at "0". Edge detect circuit 81 is composed of, for instance, digital or analog differential circuit.

The sustain flag to show on/off of sustain switch 17 is stored at sustain on/off register 82 by controller 2, and is supplied to selector 80. In the sustain mode, the sustain envelope data is sent to multiplication device 71 from the second sustain register 76. In the non-sustain mode, the release envelope data is sent to multiplication device 71 from the second release register 75.

Envelope generator 67 is disposed for each of sound source circuits 63 . . . , that is, for every component tone signal commonly shared by a plurality of keys on keyboard 11. Therefore if there is one key-off operation on keyboard 11, it does not release all the component tone signals/sine waves which are commonly shared by a plurality of keys, component tones are not released if their keys are not related to the key-off operation, and the sustain state is able to be provided for a plurality of keys. In addition if there is one key-off operation when tones of other keys have been sustained, the sustain state is not switched to the release state and the sustain state is maintained.

The release envelope speed data of the first release register 72 and the sustain envelope speed data of the first sustain register 73 may be switched over according to musical factors, or the combination of the relative values of the release envelope speed data and the sustain envelope speed data maybe switched over. In this case component tone envelope table 31 stores and reads these release envelope speed data and sustain envelope speed data according to every musical factor.

The circuits shown in FIGS. 12 and 13 can be analog as well as digital. The waveforms of the component tone signals may take any form such as sine, wave, cosine wave, triangular wave (chopping wave), saw tooth wave, rectangle wave, trapezoid wave, wave having step, complicated wave, etc. Other structure, working and effect of the second embodiment shown in FIGS. 12 and 13 are the same as the first embodiment, and are regarded to be explained in this embodiment. The content of the second embodiment is regarded to have been stated in the first embodiment. For instance, the envelope synthesis process shown in FIG. 8 is practiced in this embodiment and is practiced at the key-on/off event of keyboard 11.

(13) Entire Circuits (The Third Embodiment)

Figure 14:
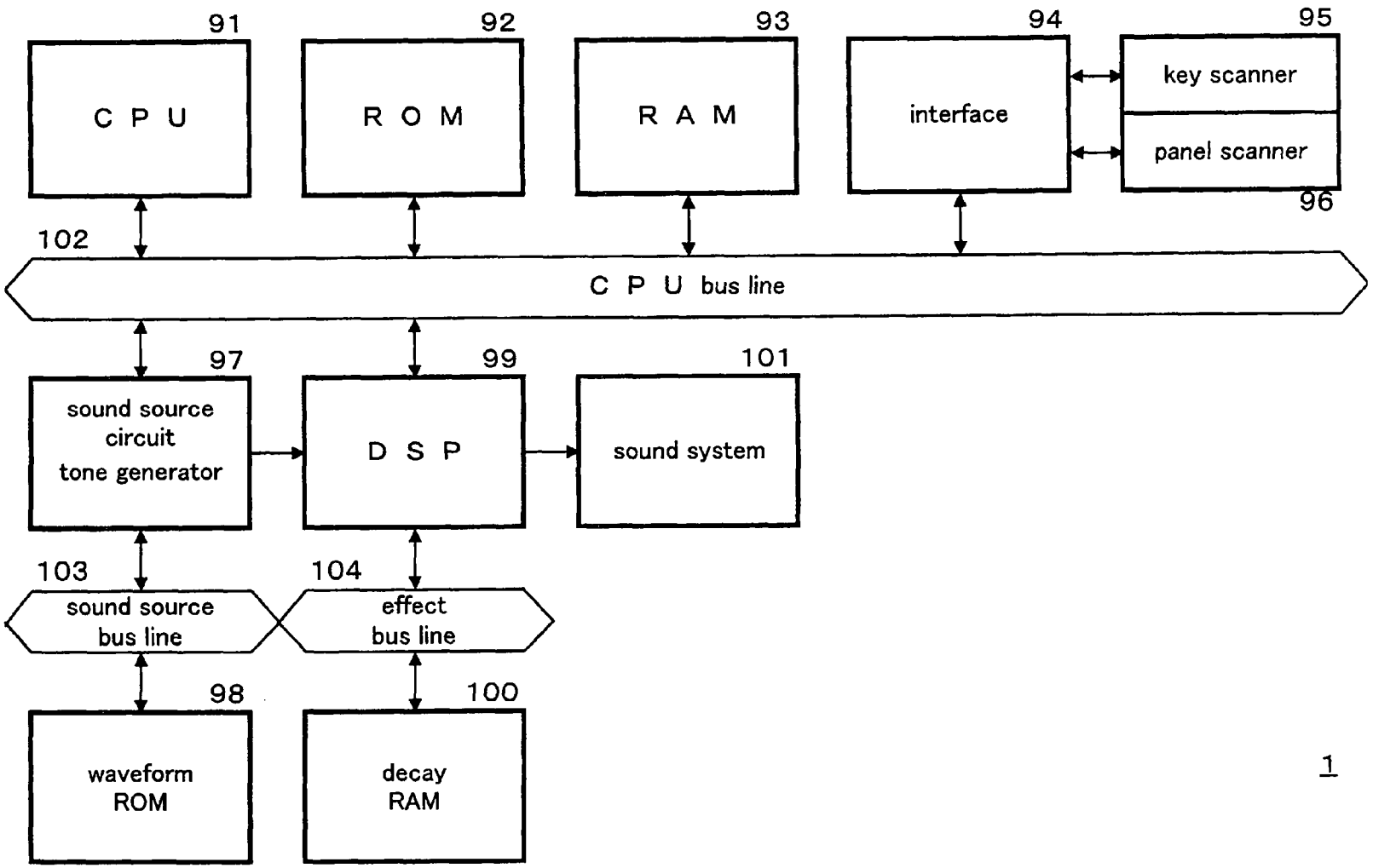
FIG. 14 shows the third embodiment of the whole circuit of the component tone synthesis apparatus.

FIG. 14 shows the third embodiment including an entire circuit executing the computer program to realize the component tone synthesis method, an entire circuit executing the component tone synthesis method, the component tone synthesis apparatus, a tone envelope control apparatus, a tone control apparatus and an entire circuit 1 of automatic play apparatus or an electronic musical instrument.

The third and second embodiments do not include a key assigner which assigns channels. Sound circuit/sound source circuit (sound source circuit 63 . . . , DCO (digital controlled oscillator) 108 . . . , DCA (digital controlled amplifier) 109 . . . ) are disposed corresponding to all the keys on keyboard 11. The same sound circuit/sound source circuit is commonly used/shared by the same pitch. The first embodiment has a key assigner.

Based on the program stored at ROM 92, CPU (controller) 91 executes various processes and the various process data are stored at RAM 93. This program corresponds to the flowcharts stated formerly or later. Through the interface circuit 94, the scanned information from CPU 91 is transmitted to and from key scanner 95 or panel scanner 96. Performance information or tone information from key scanner 95 or panel scanner 96 is transmitted to and from CPU 91.

Based on the information for forming waveforms stored at the waveform ROM 98, sound source circuit (tone generator) 97 creates tone wave signals. Based on the envelope information, the tone wave signals are added with the envelope controlled for the effect of attack, decay, sustain and release or for sustain effect.

DSP (Digital signal processor) 99 adds musical effects such as rolling, resonance and reverberation base on the information stored at Decay RAM 100, and sound system 101 outputs and generates tones.

Data and information are exchanged through CPU bus 102 among CPU 91, ROM 92, RAM 93, interface circuit 94, key scanner 95 and panel scanner 96. Between sound source circuit 97 and waveform ROM 98, data and information are exchanged through sound source bus 103. Between digital signal processor 99 and decay RAM 100, data and information are exchanged through effect bus 104.

(14) Panel Switch Group 105 (The Third Embodiment)

Figure 15:
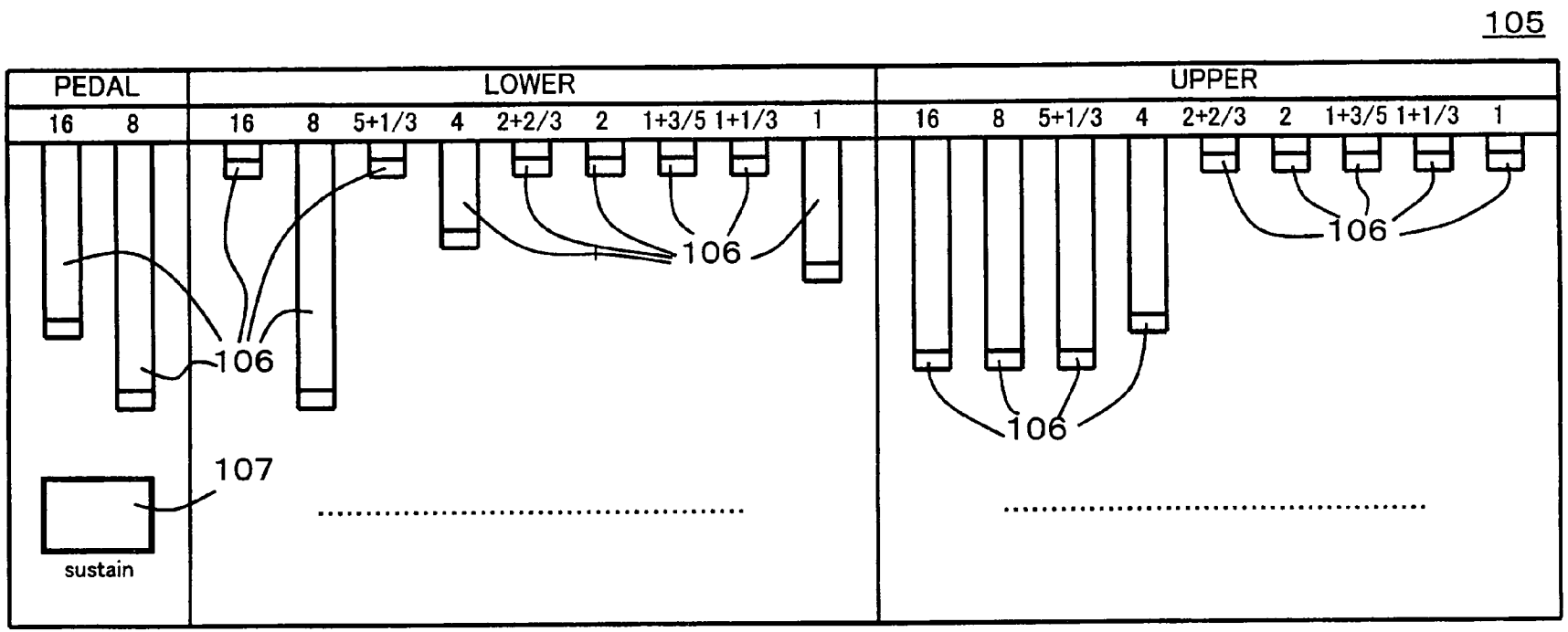
FIG. 15 shows panel switches 105 (the third embodiment)

FIG. 15 shows panel switch group 105 in the third embodiment. Keyboard 11 is composed of three/a plurality of parts such as the upper, lower and pedal. Accordingly panel switch group 106 is divided into three/a plurality of parts. Panel switch group 105 includes other kinds of operators besides switches. Each part of panel switch group 105 has draw-bars 106 . . . . The pedal part has two draw-bars. The lower part has nine draw-bars, and the upper part has nine draw-bars.

For the pedal part, one of draw-bars 106 . . . is eight feet (2nd harmonic), and the other is 16 feet (fundamental note). The draw-bars 106 . . . for the lower and upper parts are one foot (16th harmonic), 1+⅓ feet (10th harmonic), 1+⅗ feet (10th harmonic), two feet (8th harmonic), 2+⅔ feet (7th harmonic), four feet (6th harmonic), 5+⅓ feet (3rd harmonic), eight feet (2nd harmonic) and sixteen feet (fundamental note).

Draw-bar 106 is connected to a resistor which converts a voltage determined by the slide of draw-bar 106 from analog to digital and the converted voltage value is taken into CPU 91 etc.

The degree of the slide of draw-bar 106 changes and determines the level/synthesis ratio of waveforms having different cycles such as sine waves of fundamental note and harmonic notes, and changes and determines the form of the synthesized wave as a result of synthesizing such waves. Sustain switch 107 is the same as sustain switch 17 in FIG. 1.

The component tones of different feet mutually contain another component tone of different feet. Take 8 feet (2nd harmonic) and 16 feet (fundamental) component tones for example; an 8 feet (2nd harmonic) component tone is shared by the two component tones. 8 feet (2nd harmonic) and 16 feet (fundamental) component tones share a 5+⅓ feet (3rd harmonic) component tone.

8 feet (2nd harmonic) and 5+⅓ feet (3rd harmonic) component tones share a 10+⅔ feet (1.5th harmonic) or 4 feet (6th harmonic) component tone. 2 feet (8th harmonic) and 1+⅗ feet (10th harmonic) component tones share 13+⅓ feet (1.2nd harmonic), ⅘ feet (20th harmonic) or ⅖ feet (40th harmonic) component tones. This is the same in the first and second embodiments.

(15) Sound Source Circuit (Tone Generator) 97 (The Third Embodiment)

Figure 16:
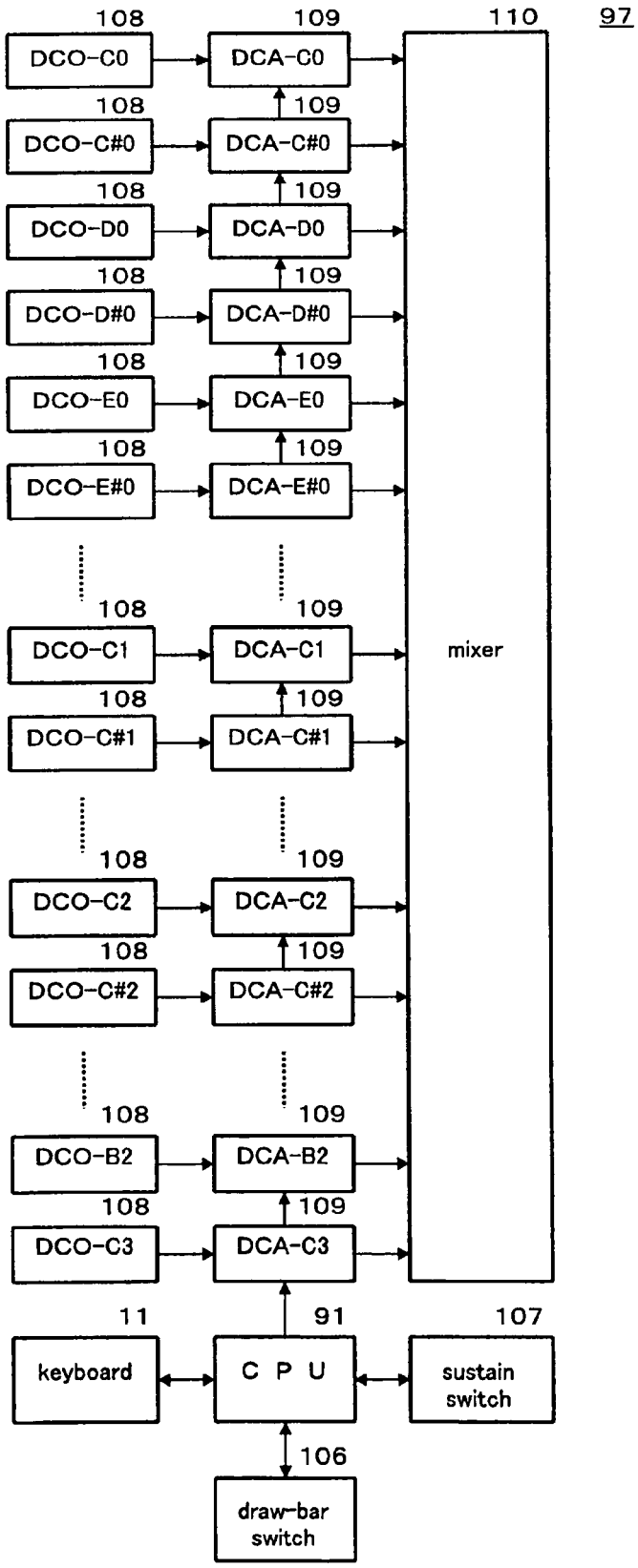
FIG. 16 shows a part of tone generators 97 responsive to twenty-five keys C0~C2 of pedal keyboard 11 (the third embodiment).

FIG. 16 shows a portion of sound source circuit (tone generator) 97 which is responsive to the twenty-five keys C0~C2 of keyboard 11. DCO (digital control oscillator) 108 . . . is a digitally controlled oscillator and there are thirty-seven oscillators installed.

There are twenty-five oscillators of 16 feet and C0~C2 pitches and twenty-five oscillators of 8 feet and C1~C3 pitches. Twelve of them are shared for C1~C2 pitches. Therefore 25+25−1−12=37 oscillators. DCO 108 . . . is similar to sound source circuit 63 . . . and generates sine waves of different frequencies corresponding to C0~C3 pitches as the component tone signals. It outputs a frequency corresponding to the pitch of each key as a fundamental note.

Thirty-seven DCA (digital control amplifier) 109 . . . control the level/synthesis ratio of each component tone signal generated from each of DCO 108 . . . . Mixer 110 synthesizes them into one tone signal, which is sent to sound system 101 through digital signal processor 99 to generate tones.

As formerly stated, key scanner 95 detects pitches of keys at their on-key and off-key events and panel scanner 96 detects the degree of the slide of the draw-bars. The level/synthesis ratio/gain of each DCA 109 is determined by the above pitches and the degree of slide. In addition, the rate/speed of the change of the level/synthesis ratio/gain is controlled. The tone waveform signals control the envelopes of attack, decay, sustain and release. Operation to turn on sustain switch 107 controls the envelope so as to add the sustain effect giving gradual attenuation.

(16) Overall Processes (The Third Embodiment)

Figure 17:
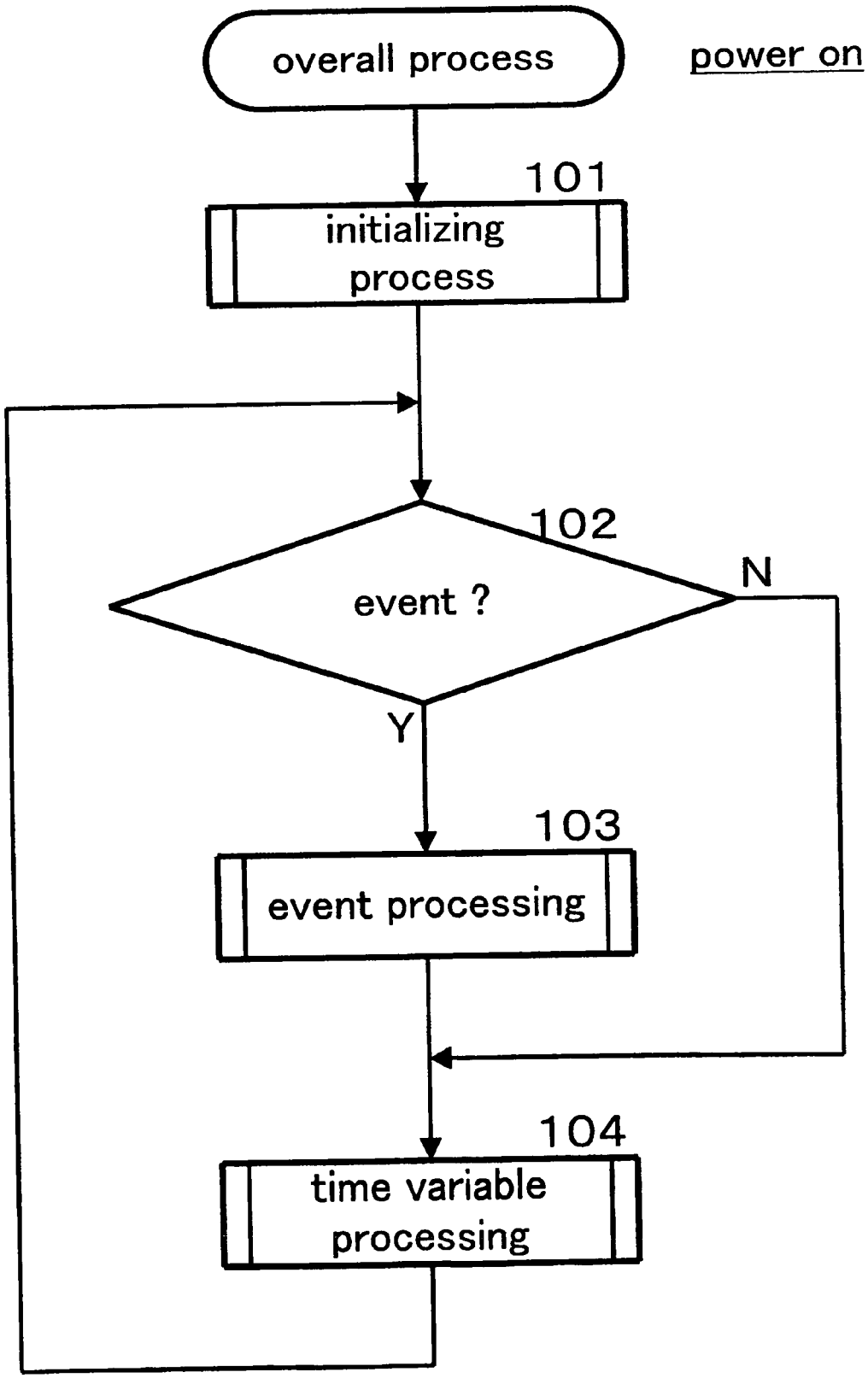
FIG. 17 shows a flowchart of all the processes executed by CPU (controller) 91 (the third embodiment).

FIG. 17 shows a flowchart of the overall processes executed by CPU (controller) 91. The processes start at turning on the power of the component tone synthesis apparatus, and the processes are repeated until the power is shut off. First, various initialization processes such as initializing RAM 93 are carried out as described later (step 101).

Secondly, when on-event or off-event of keyboard 11 or panel switch group 105 takes place (step 102), the next process is executed responsive to the event (step 103). Then time variable process is executed (step 104). The processes from step 102 through step 104 are repeated until the power is shut off. The time variable process is made for a variable that changes as time passes, such as an attenuation process of percussive tones.

(17) Initialization Process (Step 101) (The Third Embodiment)

Figure 18:
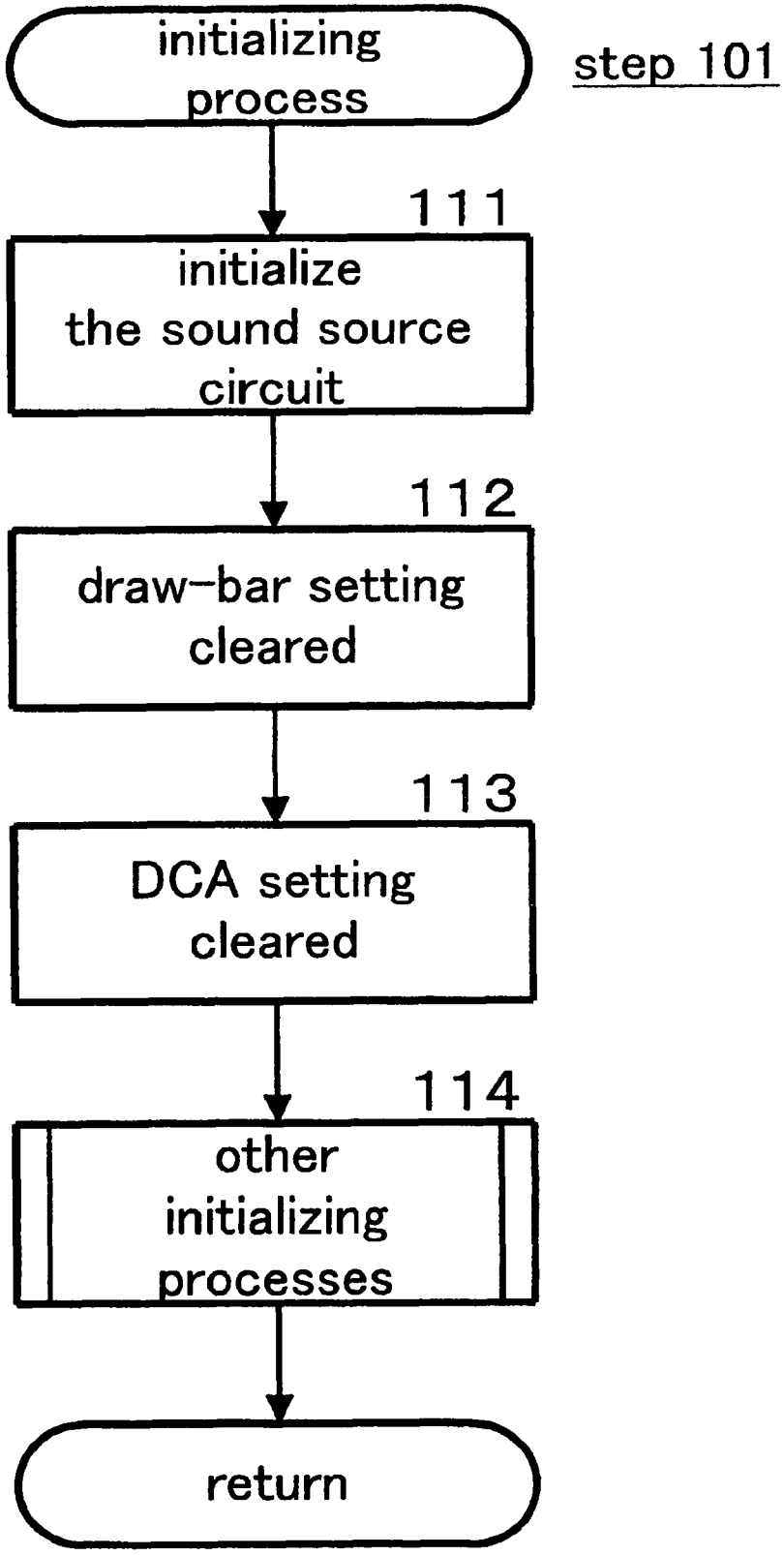
FIG. 18 shows a flowchart of the initializing processes in step 101 of FIG. 17 (the third embodiment).

FIG. 18 shows a flowchart of the initialization process step 101 in FIG. 17. First of all sound source circuit 97 is initialized. It means that the waveforms and frequencies of DCO 108 are set at certain waveforms and frequencies, the gain/level/synthesis ratio of DCA 109 are reset at "0", and the synthesis ratio of Mixer 110 is set at a certain value (step 111).

Next the storage area for draw-bars 106 . . . in RAM 93 is cleared, that is, data of the degree of shifting/setting of all the draw-bars 106 . . . is reset at "0" (step 112), and the storage area of DCA 109 . . . in RAM 93 is cleared. That means the data of gain value/level value/synthesis ratio value of all DCA 109 . . . is reset at "0" (step 113). Lastly the other initialization processes are executed (step 114).

(18) Event Processes (Step 103) (The Third Embodiment)

Figure 19:
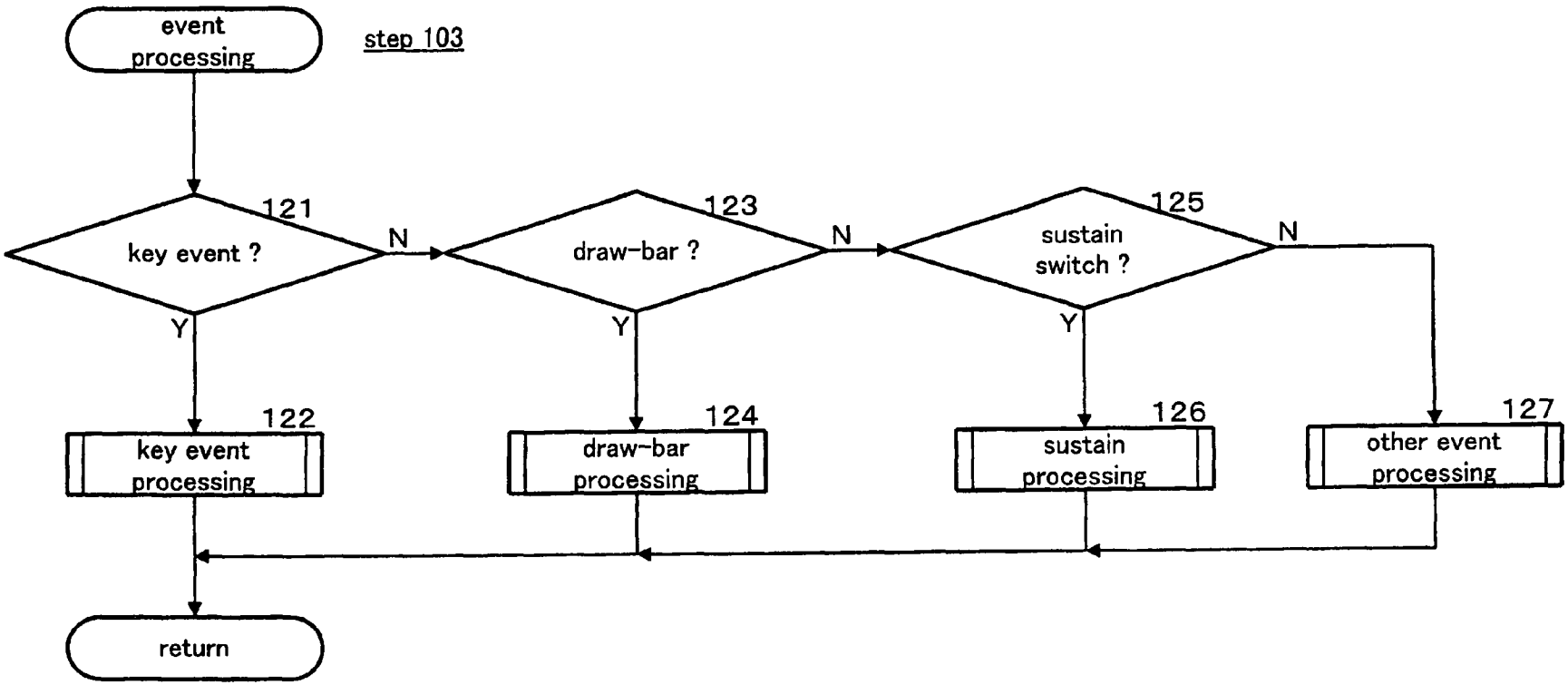
FIG. 19 shows a flowchart of the event processes (step 103) of FIG. 17 (the third embodiment).

FIG. 19 shows a flowchart of event processes (step 103) in FIG. 17. First if any key-on or key-off takes place on keyboard 11 (step 121), a key event process such as sounding on or off process is executed in response to the key event on keyboard 11 (step 122).

If the above event is practiced by the operation of draw-bars 106 . . . in panel switch group 10 (step 123), the draw-bar processes are executed in response to the degree of shifting/setting of draw-bars 106 . . . (step 124). If the above event is practiced by the on or off operation of sustain switch 107 is turned on (off) (step 125), data showing the state of the sustain switch is switched between on "1" and off "0" (step 126). Otherwise other event processes are executed (step 127).

(19) Key Event Processes (Step 122) (The Third Embodiment)

Figure 20:
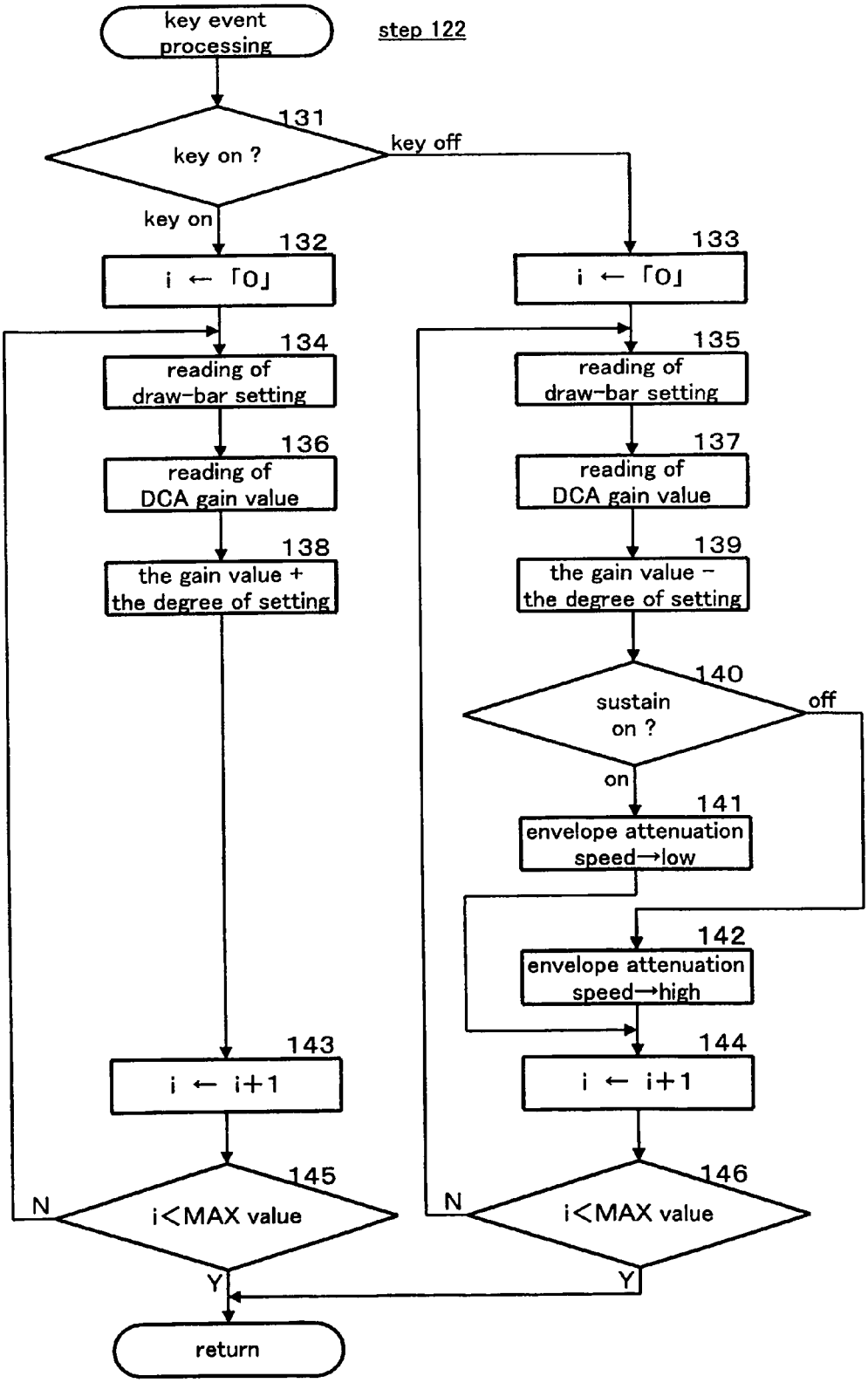
FIG. 20 shows a flowchart of the key event processes (step 122) of FIG. 19 (the third embodiment).
Figure 21:
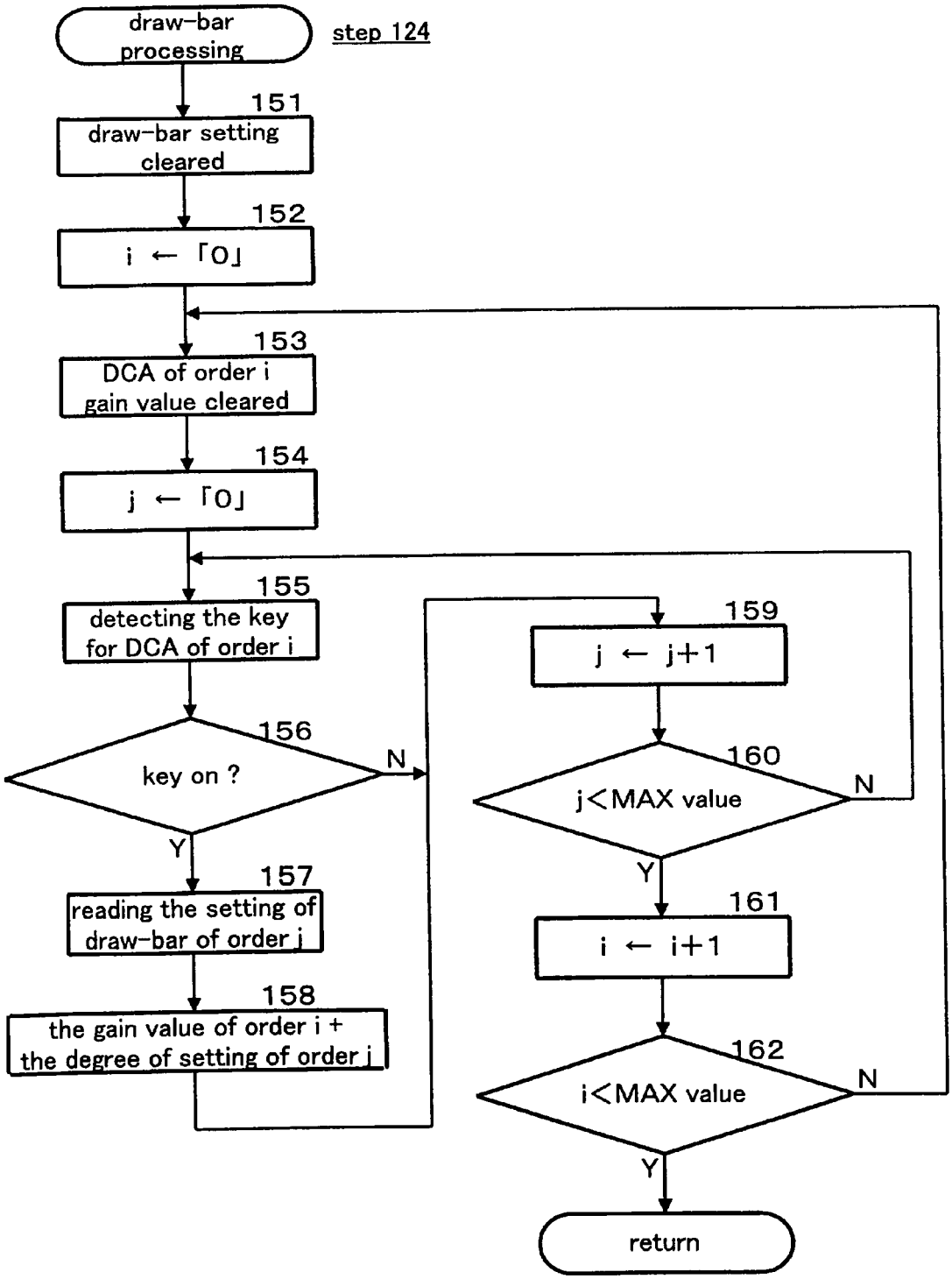
FIG. 21 shows a flowchart of the draw-bar processes (step 124) of FIG. 19 (the third embodiment).

FIG. 20 shows a flowchart of the key event processes (step 122) in FIG. 19. First at the time of the key on and off events (step 131), the setting is i=0 (steps 132, 133) and the degree of shifting/setting of draw-bar of order "i" 106 is read out (steps 134, 135).

What is read out next is the gain value/level value/synthesis ratio value of DCA 109 which works to generate a tone of the key connecting to the key event of draw-bar 106 of order "i" (steps 136, 137).

The degree of shifting/setting/synthesis ratio of draw-bar 106 is added to or subtracted from the gain value/level value/synthesis ratio value of DCA 109 (steps 138, 139).

In this occasion, if the event is key-on (step 131), the above values are added, and if it is key-off (step 131), the above values are subtracted. The added or subtracted values will be new target values of envelopes.

Thus at the time of key-on, what is added is an envelope of a component tone signal solely related to the new key-on. At the time of key-off, what is eliminated is an envelope of a component tone signal solely related to the new key-off, and no other envelopes are eliminated.

Next, at the time of key-off event (step 131), if sustain switch 107 is on (step 140), the rate/speed of calculating attenuation of the envelope is made smaller (step 141). If sustain switch 107 is off (step 140), the rate/speed of calculating attenuation of the envelope is made larger (step 142).

Thus if one key-off operation takes place while other keys keep sustaining the tones, the sustain state is not turned to the release state and the sustain state is maintained.

The above processes 131 through 141 are repeated for all the draw-bars 106 (steps 145, 146) with the "i" value increased by "1" at every cycle (steps 143, 144). The processes are not limited to pedals, but repeated in the same way for lower, upper and all the draw-bars 106 . . . .

(20) Draw-Bar Processes (Step 124) (The Third Embodiment)

FIG. 20 shows a flowchart of draw-bar processes (step 124) in FIG. 19. First, the degree of shifting/setting of draw-bar 106 in RAM 93 is cleared (step 151). The "i" value is set at "0" (step 152). The gain/level value of DCA 109 of order "i" in RAM 93 is cleared (step 153), and the "j" becomes "0" (step 154).

The next step is to detect the key connecting to DCA 109 of order "i" (step 155). If this key is pressed/on (step 156), the degree of shifting/setting of draw-bar 106 of order "i" is read (step 157) and added to the gain/level value of DCA 109 of order "i" (step 158).

The processes 155 through 158 are repeated for all the draw-bars 106 (step 160) with the "j" value increased by "1" at every cycle (step 159). Then the "i" value is increased by "1" at every cycle (step 161), and the processes are repeated for all the keys, that is, all of the DCA 109 . . . (step 162).

Thus the degree of shifting/setting/synthesis ratio of all the draw-bars 106 . . . determine the level/synthesis ratio of the component tone signals and determine waveforms of synthetic tone signals and timbres.

The lower and upper parts are structured in the same way as the pedals but structured to respond well to more keys and more draw-bars 106 . . . . Besides shown in FIGS. 14 to 21, other structure, operation and effects of the third embodiment are the same as what are described in the above first and second embodiments. The descriptions in the first and second embodiments are regarded as being stated here in the third embodiment. Similarly the description in the third embodiment is regarded as being stated in the first and second embodiments. For instance, the envelope synthesis processes shown in FIG. 8 are practiced in the third embodiment at the time of the on-event or off-event of keyboard 11 during the event processes (step 103).

(21) Other Embodiments

The present invention is not limited to the embodiments stated above and can be modified in the various ways so far as the modification does not go beyond the purpose of the present invention. For example, the component tone code data may show "the number" of component tone signals used for the synthetic tones which are being generated. In the above embodiments, component tone generator 21 being used is "1" and component tone generator 21 not being used is "0".

However in other embodiments, component tone generator 21 which is not used is "0", but component tone generator 21 which is used can be "1" or more. The "number" of component tone generators 21 being used is the "number" indicating the number of component tone signals fed to the synthetic tones.

In this occasion at step 14 in FIG. 6, it is recognized that each bit of the synthetic component tone code data is "1 or more" and that each bit of the component tone code data which have been read out is "1". At step 19, the bit value of each component tone code data read out at step 121 is added to the bit value of each synthetic component tone code data in program/data storage unit 4, and the result becomes the above synthetic component tone code data.

At step 35 in FIG. 7, rewritten to data of synthetic envelope are envelope speed data ES and envelope time data ET of the release or sustain part of the component tone envelope corresponding to the "1 or more" bit of the component tone code data which has been read out.

At steps 38 and 39, among the component tone code data stored in program/data storage unit 4 at step 20, the same component tone code data that have been read out at steps 33 and 34 are decreased by "1", and the result becomes a new synthetic component tone code data.

The above component tone signals have their own fixed frequencies. However, the frequencies may be changed by tuning. When a component tone signal is shared, it has one fixed frequency.

A plurality of sustain switches 17 are disposed for every register/pitch, performance area (part), touch, timbre, sounding time or/and the number of tones. The sustain may or may not be added to every register, part, touch or/and timbre.

The component tone code data and envelope data of component tone envelope table 31 in FIG. 4 are stored for every key number data KN/pitch/register and every tone number data TN/timbre. The data may be stored at a different/same value for every touch, sounding time, performance area/part or/and the number of tones.

In this occasion the component tone code data and envelope data are read out in response to the touch, sounding time, performance area (part), the number of tones, timbre or/and pitch/register based on the above musical factors. The data are stored at tone signal generator 5. A variety of combinations of component tones are selected according to a variety of combinations of the musical factors, and different envelope signals are generated according to a different set of musical factors.

Component tone generators 21 . . . generate sine waves, and also may generate cosine waves, triangular waves (chopping waves), saw tooth waves, rectangle waves, trapezoid waves, waves having steps, complicated wave, etc. The generator may store, switch and select waveforms which vary according to timbre, pitch/register, touch, performance area/part and sounding time. Such complicated waveforms are read out and fed as tone waveforms of the above component tones.

Component tones generated from component tone generators 21 . . . may be one independent tone, which is not a component tone. In this situation, the same component tone generator 21 generates tones having the same waveform and pitch (frequency). Envelopes and the volume of generation can be synthesized similarly.

In addition, synthesized can be amplitude of component tone signals besides envelopes. In this situation, synthesized at steps 15 and 34 are factors to determine amplitude such as touching data TC. And touch data TC is added to the accumulated touch data at every on-event and off-event. The added touch data TC is sent to multiplication device 22 . . . , where component tone signals are multiplied by the touch data TC.

The added touch data TC may be multiplied by envelope speed data ES of each component tone signal. The multiplied envelope speed data ES is used to synthesize envelopes at steps 15 and 34.

The envelope data are calculated from envelope speed ES and envelope time ET. The memory has stored in advance the envelope level data of attack, decay, sustain and release, and read out the data. If some of the envelope level data that have been read out are the same, they may be added, synthesized and fed. As a result, the envelope synthesis processes shown in FIG. 8 become unnecessary and the envelope level data which are read out are added.

The same number of envelope generators 24 . . . are prepared as component tone generators 21 . . . . However, either or both of them can be less by time-division processing. In this situation envelope calculation register 48, envelope time register 49 and phase counter 50 possess a plurality of channel memory areas, which store data corresponding to the number of time-division channels and feed the data one after another alternately.

The envelope data may be replaced by the envelope speed data ES and the envelope level data EL, or the envelope level data EL and the envelop time data ET. In this situation, the difference between the two adjacent envelope level data is divided by the envelope speed data ES and the envelope time data ET is found out. The difference between the two adjacent envelope level data EL is divided by the envelope time data ET and the envelope speed data ES is found out.

In the first embodiment the key assigner is disposed to assign a channel to each tone, each component tone or each key. The key assigner may be eliminated and tone signal generator may be disposed to every component tone signal. On the other hand, the second and third embodiments are not provided with the key assigner, however, the key assigner may be provided like the first embodiment.

The present invention can be applied to electronic musical instruments and computers. Functions of all the circuits shown in the figures above mentioned may be applied to software/flowcharts. Functions of all the flowcharts shown in the figures may be applied to hardware/circuits. The present invention described in the claims can be applied to media to store a computer program to have a computer practice the present invention, an apparatus/method to transfer a computer program, tone generation apparatus/method and tone control apparatus/method.

(22) The Other Effects of the Invention

[1] A component tone synthesis method, wherein numerous component tone signals are generated having different frequencies and the same waveform and the numerous component tone signals are synthesized to generate one synthesized tone; a plurality of means for directing generation and extinction of said tones of different pitches and sharing a part or all of the above numerous component tone signals; and when some of the means of the plurality of the above direction means have been generating tones extinct the tone, envelopes of the component tone signals to extinct tones are distinguished from envelopes of the other component tone signals not to extinct tones in order to get into the release state only the envelopes of the component tone signals to extinct tones and to maintain the state of the envelopes of the other component tone signals not to extinct tones or of synthesized envelopes instead of getting into the release state.

[2] A computer program for synthesizing component tone having a computer execute, wherein processing to which numerous component tone signals are generated having different frequencies and the same waveform and the numerous component tone signals are synthesized to generate one synthesized tone; processing to which a plurality of means for directing generation and extinction of said tones of different pitches and sharing a part or all of the above numerous component tone signals; and processing to which when some of the means of the plurality of the above direction means have been generating tones extinct the tone, envelopes of the component tone signals to extinct tones are distinguished from envelopes of the other component tone signals not to extinct tones in order to get into the release state only the envelopes of the component tone signals to extinct tones and to maintain the state of the envelopes of the other component tone signals not to extinct tones or of synthesized envelopes instead of getting into the release state.

[3] A component tone synthesis apparatus, wherein numerous component tone signals are generated having different frequencies and the same waveform and the numerous component tone signals are synthesized to generate one synthesized tone; a plurality of means for directing generation and extinction of said tones of different pitches and sharing a part or all of the above numerous component tone signals; and when some of the means of the plurality of the above direction means have been generating tones extinct the tone, envelopes of the component tone signals to extinct tones are distinguished from envelopes of the other component tone signals not to extinct tones in order to get into the release state only the envelopes of the component tone signals to extinct tones and to maintain the state of the envelopes of the other component tone signals not to extinct tones or of synthesized envelopes instead of getting into the release state.

[4] A component tone synthesis apparatus according to claim 3 comprising: means for switching a sustain state in which tones are gradually attenuated after the sounding stop is directed by the above direction means and a release state in which tones are attenuated at a normal speed; and wherein when some envelopes of the commonly shared component tone signals have been in the sustain state and some direction means extinct tones while the direction means have been directing to generate tones, envelopes of the component tone signals not to extinct the tones or synthetic envelopes are maintained in the sustain state, and the component tone signals to extinct the tones are made to form the envelopes of the sustain state or the release state.

[5] A component tone synthesis apparatus according to claim 3 or 4 comprising means for synthesizing envelopes, wherein when at least two synthetic tones are sounding simultaneously but the timings of the start or stop of the sounding operations are not simultaneous, envelopes of the respective component tone signals are synthesized at the timings of starting operation of the latter synthetic tone and stopping operation of the former synthetic tone into one synthetic envelope for one component tone signal.

By this processing, at the start or stop of the sounding operations, an envelope of a component tone signal commonly shared by different synthetic tones is synthesized, so that envelopes do not have to be formed for each of the synthetic tones separately.

[6] A component tone synthesis apparatus according to claim 3, 4 or 5, wherein the level of the envelope synthesized after the timing of stopping operation the former synthetic tone as stated above approaches gradually to the level of the envelope formed by the component tone signal of the synthetic tone whose stopping operation has not been conducted yet.

By this processing, tones/component tones whose stopping operation has not been conducted yet are kept sounding.

[7] A component tone synthesis apparatus according to claim 3, 4 or 5, wherein the state of the above envelope is switched from the sustain state in which tones are slightly attenuated after of the stop of the sounding operation to the release state in which tones are attenuated at a normal speed;

the envelope of each component tone signal states above approaches to "0" in the release state; and in the sustain state, the envelope of each component tone signal stated above gradually approaches to "0" and the levels of some or all of the component tone signals whose levels are "0" are changed gradually to the value except "0" and then gradually approach to "0".

By this processing, contents of the synthesized component tones are made different/switched, and timbres are made different/switched in there leases state and the sustain state.

[8] A component tone synthesis apparatus according to claim 3, 4, 5, 6 or 7, wherein When the component tone signal is unnecessary for making the synthetic tone is when said component tone signal is not included in the components of the synthetic tone, before the start of sounding operation of said synthetic tones or when the envelope of said synthetic tone has been completely attenuated after the stop of sounding operation of said synthetic tone.

By this processing, when the component tone signal turns to be a component of the synthetic tone from the state in which the signal is not a component of the synthetic tone, when the key-off state turns to be the key-on state, when the key-on state turns to be the key-off state, such processing become unnecessary as vacant channels or assignment channels are searched, so that processes of starting and stopping tones become more rapid, and reaction to the operation of starting and stopping tones become quicker.

And in the key assigning process by time division, it becomes unnecessary to search and find out identical frequencies between all the component tones of all the tones which have been assigned to channels and all the component tones of tones which are going to be assigned to channels or all the component tones of tones which are going to be stopped sounding, so that processes of starting and stopping tones become more rapid and reaction the operation of starting and stopping tones become quicker.

[9] A component tone synthetic apparatus according to claim 3, 4, 5, 6, 7 or 8, wherein the direction means correspond to a plurality of different pitches, and a plurality of the component tone signals have frequencies roughly corresponding to all the different pitches and frequencies of their $2^n$ multiple (n=1, 2, 3, . . . ).

By this processing, common component tone signals are shared by tones having the same pitch name but are different in pitches by octaves, so that component tone signals can be utilized efficiently and effectively.

[10] A component tone synthetic apparatus according to claim 3, 4, 5, 6, 7, 8 or 9 comprising the steps of: storing the synthesis information which of the above plenty of component tone signals are or are not to be synthesized; at the start of the latter sounding operation stated above, finding a synthetic envelope from the component tone signals, if the synthesis information of the component tone signals which have been generating tones and the synthesis information of the component tone signals which have just started to generate tones is "to synthesize"; starting to generate tones according to the envelopes of the component tone signals which have just started to generate tones, if the synthesis information of the component tone signals which have been generating tones is "not to synthesize" and the synthesis information of the component tone signals which have just started to generate tones is "to synthesize"; and taking no subsequent operations, if the synthesis information of the component tone signals which have been generating tones is "not to synthesize" or "to synthesize" and the synthesis information of the component tone signals which have just started to generate tones is "not to synthesize".

By these steps judgment is made whether envelopes will be synthesized or not based on the synthesis information, and the process to start sounding is made rapid and the reaction to actual start of sounding is made quicker.

[11] A component tone synthesis apparatus according to claim 3, 4, 5, 6, 7, 8, 9 or 10 comprising the steps of: storing the synthesis information which of the above plenty of component tone signals are or are not to be synthesized; at the stop of the former sounding operation stated above, finding a synthetic envelope from the component tone signals, if the synthesis information of the component tone signals which have been generating tones is "not to synthesize" or "to synthesize" and the synthesis information of the component tone signals which have stopped generating tones is "to synthesize".

By these steps judgment is made whether envelopes will be synthesized or not based on the synthesis information, and the process to stop sounding is made rapid and the reaction to actual stop of sounding is made quicker.

[12] A component tone synthesis apparatus according to claim 3, 4, 5, 6, 7, 8, 9, 10 or 11 comprising the steps of: storing the synthesis information which of the above plenty of component tone signals are or are not to be synthesized in the gradually attenuated sustain state; starting the sustain state at the stop of the former sounding operation; and finding a synthetic envelope in the sustain state from the component tone signals, if the synthesis information of the component tone signals which have been generating tones is "not to synthesize" or "to synthesize" and the synthesis information of the component tone signals which have stopped generating tones is "to synthesize".

By these steps judgment is made whether envelopes will be synthesized or not in the sustain state as well based on the synthesis information, and the process to stop sounding is made rapid and the reaction to actual stop of sounding is made quicker.

[13] A component tone synthesis apparatus according to claim 2, 3, 4, 5, 6, 7, 8, 9, 10, 11 or 12, wherein every time the synthetic envelope is find hereinabove, the synthesis information of the component tone signals which are generating tones is renewed.

By these steps, the synthesis information is able to be renewed at every start and stop of the sounding operation, so that the judgment can be made correctly and rapidly whether envelope will be synthesized or not.

[14] A component tone synthesis apparatus according to claim 3, 4, 5, 6, 7, 8, 9, 10, 11, 12 or 13 wherein the ratio of the synthesized component tone signals or the ratio of the component tone signals shared as above to all the component tone signals is changeable.

Accordingly timbres of the synthesized tones are changeable.

[15] Computer program/component tone synthesis apparatus for synthesizing component tones according to claim 3, 4, 5, 6, 7, 8, 9, 10, 11, 12, 13 or 14 comprising the CPU executing the component tone synthesis method of: constantly generating numerous component tone signals with fixed frequencies, which differ by a factor of two or more with each other, and with the same waveform; synthesizing the numerous component tone signals herein so as to generate a single tone; generating envelopes in order to change the level of each of the component tone signals from "0" to a certain value individually to be synthesized into the component tone signal; setting the level of the envelope of the component tone signal at "0" when said component tone signal is unnecessary to the synthetic tones hereinabove; forming a synthetic envelope for each of the component tone signals contained in at least two synthetic tones, which are sounding simultaneously for some length of time but the timings of starting and stopping operations of the tones are different, at the start of the latter sounding or at the stop of the former sounding; and synthesizing the formed envelope as the one envelope in each of the component tone signals.

By these processes, unnecessary component tone signals stay at "0" though plenty of component tone signals are always generated, so that unnecessary component tone signals cannot be heard.

[16] A computer program for synthesizing component tones/component tone synthesis apparatus according to claim 3, 4, 5, 6, 7, 8, 9, 10, 11, 12, 13, 14 or 15 comprising the steps of: changing the level of each component tone signal from "0" to "a determined value" by generating an envelope for this purpose and synthesizing the envelope in each component tone signal; setting the level of the envelope of the component tone signal at "0" if said component tone signal is unnecessary to the synthesized tone.

By these processes, unnecessary component tone signals stay at "0" though plenty of component tone signals are always generated, so that unnecessary component tone signals cannot be heard.

Unlike the key assigner by the time division, such processes become unnecessary as to search vacant channels at the key-on event or to search channels assigned to tones which are to be stopped at the key-off event, so that processes of starting and stopping operation of tones are made more rapid and the reactions to actual start and stop of sounding are made quicker.

In the key assigner by the time division, it is necessary to search and find out identical frequencies between all the component tones of all the tones which have been assigned to channels and all the component tones of tones which are going to be assigned to channels or are going to be stopped sounding, so that a process of starting operation of tones is made slow and the reaction to actual start of sounding is made slow. This is more obvious when the number of tones generated simultaneously is larger.

What is claimed is:

1. A component tone synthesis method, comprising:

step for generating and synthesizing numerous component tone signals having different frequencies and the same waveform and the numerous component tone signals to generate one synthesized tone; and in connection with a plurality of direction means for directing generation and off operation of said tones of different pitches and sharing a part or all of the numerous component tone signals, step for when some of the plurality of direction means have been directing together and generating tones operated off, distinguishing envelopes of the component tone signals to be operated off from envelopes of the other component tone signals not to be operated off, and getting into a release state only the envelopes of the component tone signals to be operated off, and maintaining the state of the envelopes of the other component tone signals not to be operated off or of synthesized envelopes not to be into the release state.

2. A non-transitory computer readable medium storing a program for causing a computer to execute a process for synthesizing component tone, the process comprising:

processing for generating and synthesizing numerous component tone signals having different frequencies and the same waveform and the numerous component tone signals to generate one synthesized tone; and in connection with a plurality of direction means for directing generation and off operation of said tones of different pitches and sharing a part or all of the numerous component tone signals, processing for when some of the plurality of direction means have been directing together and generating tones operated off, distinguishing envelopes of the component tone signals to be operated off from envelopes of the other component tone signals not to be operated off, and getting into a release state only the envelopes of the component tone signals to be operated off, and maintaining the state of the envelopes of the other component tone signals not to be operated off or of synthesized envelopes not to being into the release state.

3. A component tone synthesis apparatus, comprising:

means for generating and synthesizing numerous component tone signals having different frequencies and the same waveform and the numerous component tone signals and the numerous component tone signals to generate one synthesized tone; and in connection with a plurality of direction means for directing generation and off operation of said tones of different pitches and sharing a part or all of the numerous component tone and signals, means for when some of the plurality of direction means have been directing together and generating tones operated off, distinguishing envelopes of the component tone signals to be operated off from envelopes of the other component tone signals not to be operated off, and getting into a release state only the envelopes of the component tone signals to be operated off, and maintaining the state of the envelopes of the other component tone signals not to be operated off or of synthesized envelopes not to be into the release state.

4. The component tone synthesis apparatus according to claim 3 further comprising:

means for switching a sustain state in which tones are gradually attenuated after the off operation by the direction means and the release state in which tones are attenuated at a normal speed; and wherein when some envelopes of the commonly shared component tone signals have been in the sustain state and some direction means are operated off while the direction means have been directing to generate tones, envelopes of the component tone signals not to be operated off or synthetic envelopes are maintained in the sustain state, and the component tone signals to be operated off are made to state the envelopes of the sustain or the release.

5. The component tone synthesis apparatus according to claim 3, further comprising:

means for synthesizing envelopes, when at least two synthetic tones are generating parallel but the timings of the on or off of the sounding operations are not simultaneous, envelopes of the respective component tone signals are synthesized at the timings of on operation of the latter synthetic tone and off operation of the former synthetic tone into one synthetic envelope for one component tone signal.

6. The component tone synthesis apparatus according to claim 3 wherein, the level of the envelope synthesized after the timing of off operation the former synthetic tone approaches gradually to the level of the envelope formed by the component tone signal of the synthetic tone whose off operation has not been conducted yet.

7. The component tone synthesis apparatus according to claim 3 wherein, the state of the envelope is switched from a sustain state in which tones are slightly attenuated after the off operation and the release state in which tones are attenuated at a normal speed;

the envelope of each component tone signal approaches to "0" in the release state; and in the sustain state, the envelope of each component tone signal gradually approaches to "0" and the levels of some or all of the component tone signals whose levels are "0" are changed gradually to the value except "0" and then gradually approach to "0".

8. The component tone synthesis apparatus according to claim 3 wherein, when the component tone signal is unnecessary for making the synthetic tone is when said component tone signal is not included in the components of the synthetic tone, before the on operation of said synthetic tones or when the envelope of said synthetic tone has been completely attenuated after the off operation of said synthetic tone.

9. The component tone synthetic apparatus according to claim 3 wherein, the direction means correspond to a plurality of different pitches, and a plurality of the component tone signals have frequencies roughly corresponding to all the different pitches and frequencies of their $2^n$ multiple (n=1, 2, 3, . . . ).

10. The component tone synthetic apparatus according to claim 3 further comprising;

means for storing the synthesis information which of the numerous component tone signals are or are not to be synthesized;

at the start of the latter on operation, a synthetic envelope is found from the component tone signals, if the synthesis information of the component tone signals which have been generating tones and the synthesis information of the component tone signals which have just started to generate tones is "to synthesize";

means for starting to generate tones according to the envelopes of the component tone signals which have just started to generate tones, if the synthesis information of the component tone signals which have been generating tones is "not to synthesize" and the synthesis information of the component tone signals which have just started to generate tones is "to synthesize"; and means for taking no subsequent operations, if the synthesis information of the component tone signals which have been generating tones is "not to synthesize" or "to synthesize" and the synthesis information of the component tone signals which have just started to generate tones is "not to synthesize".

11. The component tone synthesis apparatus according to claim 3 further comprising:

means for storing the synthesis information which of the numerous component tone signals are or are not to be synthesized;

at the stop of the former on operation, a synthetic envelope is found from the component tone signals, if the synthesis information of the component tone signals which have been generating tones is "not to synthesize" or "to synthesize" and the synthesis information of the component tone signals which have stopped generating tones is " to synthesize".

12. The component tone synthesis apparatus according to claim 3, further comprising:

means for storing the synthesis information which of the numerous component tone signals are or are not to be synthesized in the gradually attenuated sustain state;

means for starting the sustain state at the former off operation; and means for finding a synthetic envelope in the sustain state from the component tone signals, if the synthesis information of the component tone signals which have been generating tones is "not to synthesize" or "to synthesize" and the synthesis information of the component tone signals which have stopped generating tones is "to synthesize".

13. The component tone synthesis apparatus according to claim 3 wherein, every time the synthetic envelope is found, the synthesis information of the component tone signals which are generating tones is renewed.

14. The component tone synthesis apparatus according to claim 3 wherein, a ratio of the synthesized component tone signals or the ratio of the component tone signals shared to all the component tone signals is changeable.

15. The component tone synthesis apparatus according to claim 3, further comprising:

means for constantly generating numerous component tone signals with fixed frequencies, which differ by a factor of two or more with each other, and with the same waveform;

means for synthesizing the numerous component tone signals herein so as to generate a single tone;

means for generating envelopes in order to change the level of each of the component tone signals from "0" to a certain value individually to be synthesized into the component tone signal;

means for setting the level of the envelope of the component tone signal at "0" when said component tone signal is unnecessary to the synthetic tones;

means for forming a synthetic envelope for each of the component tone signals contained in at least two synthetic tones, which are sounding simultaneously for some length of time but the timings of starting and stopping operations of the tones are different, at the start of the latter sounding or at the stop of the former sounding; and means for synthesizing the formed envelope as the one envelope in each of the component tone signals.

16. The component tone synthesis apparatus according to claim 3, further comprising:

means for changing the level of each component tone signal from "0" to "a determined value" by generating an envelope for this purpose and synthesizing the envelope in each component tone signal; and means for setting the level of the envelope of the component tone signal at "0" if said component tone signal is unnecessary to the synthesized tone.

17. A component tone synthesis method, comprising:

step for generating and synthesizing numerous component tone signals of sine waves, cosine waves, triangular waves, sawtooth waves, square waves or trapezial waves having different frequencies and the same waveform and the numerous component tone signals to generate one synthesized tone; and in connection with a plurality of direction means for directing generation and off operation of said tones of different pitches and sharing a part or all of the numerous component tone signals, step for when some of the plurality of direction means have been directing together and generating tones operated off, distinguishing envelopes of the component tone signals to be operated off from envelopes of the other component tone signals not to be operated off, and getting into a release state only the envelopes of the component tone signals to be operated off, and maintaining the state of the envelopes of the other component tone signals not to be operated off or of synthesized envelopes not to be into the release state.

18. A non-transitory computer readable medium storing a program for causing a computer to execute a process for synthesizing component tone, the process comprising:

processing for generating and synthesizing numerous component tone signals of sine waves, cosine waves, triangular waves, sawtooth waves, square waves or trapezial waves having different frequencies and the same waveform and the numerous component tone signals to generate one synthesized tone; and in connection with a plurality of direction means for directing generation and off operation of said tones of different pitches and sharing a part or all of the numerous component tone signals, processing for when some of the plurality of direction means have been directing together and generating tones operated off, distinguishing envelopes of the component tone signals to be operated off from envelopes of the other component tone signals not to be operated off, and getting into a release state only the envelopes of the component tone signals to be operated off, and maintaining the state of the envelopes of the other component tone signals not to be operated off or of synthesized envelopes not to be into the release state.

19. A component tone synthesis apparatus, comprising:

means for generating and synthesizing numerous component tone signals of sine waves, cosine waves, triangular waves, sawtooth waves, square waves or trapezial waves having different frequencies and the same waveform and the numerous component tone signals to generate one synthesized tone; and in connection with a plurality of direction means for directing generation and off operation of said tones of different pitches and sharing a part or all of the numerous component tone signals, means for when some of the plurality of direction means have been directing together and generating tones operated off, distinguishing envelopes of the component tone signals to be operated off from envelopes of the other component tone signals not to be operated off, and getting into a release state only the envelopes of the component tone signals to be operated off, and maintaining the state of the envelopes of the other component tone signals not to be operated off or of synthesized envelopes not to be into the release state.

* * * * *